US007694521B2

(12) United States Patent
Ohta et al.

(10) Patent No.: US 7,694,521 B2
(45) Date of Patent: Apr. 13, 2010

(54) INSTALLATION STRUCTURE OF PILOT NOZZLE OF COMBUSTOR

(75) Inventors: Masataka Ohta, Hyogo (JP); Shigemi Mandai, Hyogo (JP); Kuniaki Aoyama, Hyogo (JP); Katsunori Tanaka, Hyogo (JP); Shinji Akamatsu, Hyogo (JP); Hisanari Nakajima, Hyogo (JP); Teruya Tachibana, Hyogo (JP); Koichi Nishida, Hyogo (JP); Wataru Akizuki, Hyogo (JP); Yoshikuni Kasai, Hyogo (JP); Jyunji Hashimura, Hyogo (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 1102 days.

(21) Appl. No.: 10/561,927

(22) PCT Filed: Mar. 3, 2004

(86) PCT No.: PCT/JP2004/002666

§ 371 (c)(1),
(2), (4) Date: Dec. 22, 2005

(87) PCT Pub. No.: WO2005/085709

PCT Pub. Date: Sep. 15, 2005

(65) Prior Publication Data

US 2007/0006587 A1 Jan. 11, 2007

(51) Int. Cl.
*F02C 1/00* (2006.01)

(52) U.S. Cl. ..... 60/748; 60/740; 60/747

(58) Field of Classification Search ..... 60/740, 60/746–747, 737–738
See application file for complete search history.

(56) References Cited

U.S. PATENT DOCUMENTS 3,735,930 A * 5/1973 Mori ..... 239/419.5
5,169,302 A * 12/1992 Keller ..... 431/173
5,450,725 A * 9/1995 Takahara et al. ..... 60/737
5,586,878 A 12/1996 Döbbeling et al.
5,901,555 A * 5/1999 Mandai et al. ..... 60/747
6,068,467 A * 5/2000 Mandai et al. ..... 431/174
6,070,411 A * 6/2000 Iwai et al. ..... 60/737

(Continued)

FOREIGN PATENT DOCUMENTS

EP 0 711 953 5/1996

(Continued)

OTHER PUBLICATIONS

Decision to Grant a Patent issued May 14, 2007 in Japanese Application No. 2002-263663.

(Continued)

*Primary Examiner*—Michael Cuff
*Assistant Examiner*—Phutthiwat Wongwian
(74) *Attorney, Agent, or Firm*—Wenderoth, Lind & Ponack, L.L.P.

(57) ABSTRACT

Pilot fuel injected from fuel injection ports 21 of a pilot nozzle 2 bumps against an inner wall surface of a tapered portion of an inner circumference of a cone 41 of a pilot cone 4. At this time, the position where a pilot fuel from the fuel injection ports 21 hits is located in a range from a middle of the tapered portion of the inner circumference of a cone 41 to a downstream-side tip thereof.

2 Claims, 13 Drawing Sheets

U.S. PATENT DOCUMENTS

| | | | | |
|---|---|---|---|---|
| 6,122,916 | A * | 9/2000 | Amos et al. | 60/747 |
| 6,282,886 | B1 | 9/2001 | Sato et al. | |
| 6,631,614 | B2 * | 10/2003 | Mandai et al. | 60/737 |
| 6,832,481 | B2 * | 12/2004 | Koenig et al. | 60/737 |
| 7,143,583 | B2 * | 12/2006 | Hayashi et al. | 60/776 |

FOREIGN PATENT DOCUMENTS

| | | |
|---|---|---|
| EP | 1 207 344 | 5/2002 |
| JP | 4-98014 | 3/1992 |
| JP | 5-215338 | 8/1993 |
| JP | 5-332512 | 12/1993 |
| JP | 5-332541 | 12/1993 |
| JP | 6-213452 | 8/1994 |
| JP | 6-257750 | 9/1994 |
| JP | 10-89689 | 4/1998 |
| JP | 10-176831 | 6/1998 |
| JP | 11-344224 | 12/1999 |
| JP | 2000-146183 | 5/2000 |
| JP | 2002-115847 | 4/2002 |
| JP | 2003-83541 | 3/2003 |
| JP | 2003-247425 | 9/2003 |
| JP | 2004-85120 | 3/2004 |
| JP | 2004-101071 | 4/2004 |
| JP | 2004-101105 | 4/2004 |

OTHER PUBLICATIONS

German Office Action (with English translation) issued Nov. 28, 2008 in connection with German Patent Application No. 112004002704.

Chinese Office Action together with English translation issued Dec. 19, 2008 in connection with Chinese Patent Application No. 200480023360 corresponding to the present U.S. application.

* cited by examiner

INSTALLATION STRUCTURE OF PILOT NOZZLE OF COMBUSTOR

TECHNICAL FIELD

The present invention relates to a combustor which is provided to a gas turbine and the like, and especially, relates to a combustor which is provided with a pilot nozzle diffusing a fuel to burn and with main nozzles mixing a fuel with the air to burn.

BACKGROUND ART

In recent years, in order to reduce air pollution, at electric generation facilities utilizing gas turbines, it is demanded to reduce NOx which is included in exhaust gas thereof. NOx in a gas turbine is generated in a combustor which performs combustion behavior in order to rotate the gas turbine. Therefore, conventionally, in order to reduce NOx being generated in a combustor, is employed a combustor having main nozzles which perform combustion (premixed combustion) by mixing the fuel with the air.

By having the main nozzles perform premixed combustion, it is possible to reduce the amount of NOx being exhausted from the combustor. However, combustion state thereof is unstable, and combustion vibrations occur. Therefore, in order to restrain the aforementioned combustion vibrations so as to make the combustion state stable, such a combustor is employed as is further equipped with a pilot nozzle which diffuses and burns the fuel (diffusion combustion). FIG. 20 shows a schematic block diagram of a combustor being provided with a pilot nozzle and main nozzles as mentioned hereinabove.

As shown in FIG. 20, inside a combustor main body 1, a pilot nozzle 2 is inserted into the center thereof. At the same time, main nozzles 3 are inserted so as to be located around the pilot nozzle 2. Then, a pilot cone 4 is installed so as to cover the tip portion of the pilot nozzle 2. Additionally, main burners 5 are installed so as to cover the tip portions of the main nozzles 3. Moreover, pilot swirls 6 are installed around the tip portion of the pilot nozzle 2, and main swirls 7 are installed around the tip portions of the main nozzles 3, so that the pilot nozzle 2 and the main nozzles 3 will be supported.

In a combustor being constructed as mentioned hereinabove, the surrounding area of the tip portion of the pilot nozzle 2 is constructed as shown in FIG. 21. The outer circumference of the tip of the pilot nozzle 2 has a plurality of fuel injection ports 21 installed so as to diffuse and inject the fuel. The fuel which is to be injected by the pilot nozzle 2 will be referred as "pilot fuel" hereinafter. Additionally, the air which is to be supplied to the surrounding area of the pilot nozzle 2 by way of the comb ustor main body 1 ("pilot air") flows along the inner wall of the pilot cone 4 after passing through the pilot swirls 6. As a result, the pilot fuel being diffused and injected by the pilot nozzle 2 burns, forming diffusion flame (F); and furthermore, a part of the pilot fuel burns and at the same time, high temperature combustion gas from the pilot diffusion flame enters, forming a low-speed flame-stabilizing zone "X" which serves as a flame stabilizing point for the main remixed flame, thereby maintaining combustion.

Additionally, the fuel being injected from the main nozzles 3 ("main fuel") flows into the main burners 5 together with the air ("main air"), passing through the main swirls 7 and is mixed inside the main burners 5, thereby letting the main fuel and the main air being mixed by the main burners 5 flow out. When an air-fuel pre-mixture which is a mixture of the main air and the main fuel flows out from the main burners 5, the air-fuel pre-mixture is burned toward the inner wall of the combustor main body 1 from the downstream-side tips of the main burners 5, based on combustion in the low-speed flame-stabilizing zone "X." Herein, "downstream" means the downstream of the fuel and the air flows.

Moreover, as a conventional technology, in order to have a low-speed flame-stabilizing zone "X" formed easily in order to maintain combustion of the air-fuel pre-mixture from the main burners 5, as shown in FIG. 22, is provided a combustor, wherein a pilot cone 4 is formed to be in such a manner as the downstream-side tip thereof projects toward the main burners 5, serving as a pilot cone 4*f* By forming the pilot cone 4*f* in the above-mentioned manner, a low-speed flame-stabilizing zone "X" is formed in the vicinity of the downstream-side tip of the pilot cone 4*f*.

However, in a combustor being provided with a pilot nozzle 2 and main nozzles 3 as shown in FIG. 21, in order to maintain stability of combustion state thereof, flame-stabilizing effect being supplied by diffusion combustion of the pilot nozzle 2 is necessary. However, because the rate of production of NOx is high when combustion is performed by the pilot nozzle 2, it is necessary to restrain combustion by the pilot nozzle 2 in order to reduce NOx.

Consequently, NOx emission from a combustor is reduced by decreasing the ratio of the fuel being provided to the pilot nozzle versus the entire fuel being provided to the combustor ("pilot ratio"). However, as mentioned hereinabove, when the pilot ratio is low, the flame-stabilizing effect cannot be obtained from the pilot nozzle 2. As a result, combustion vibrations occur, making the combustion state unstable, thereby deteriorating energy efficiency of a gas turbine.

Additionally, stability of combustion can be achieved by forming a low-speed flame-stabilizing zone "X" as shown in FIG. 22. However, in order to promote reduction in NOx further, it is necessary to decrease pilot diffusion flame, but the current low-speed flame-stabilizing zone "X" is not large enough. In addition, because the downstream-side tip of the pilot cone 4*f* is formed so as to project toward the main burners 5, a stagnant area "Y" where the air-fuel pre-mixture flowing from the main burners 5 forms vortex is formed in the portion at the outlets of the main burners 5 where the pilot cone 4*f* projects. There is a concern that formation of a stagnant area "Y" might lead to generation of flashback.

DISCLOSURE OF THE INVENTION

It is an object of the present invention to provide a combustor, wherein the pilot ratio is low and combustion vibrations are restrained. Additionally, it is another object of the present invention is to provide a combustor, wherein the low-speed flame-stabilizing area can be made larger and more reliable as well as the stagnant area can be prevented from being generated at the outlets of the main burners.

In order to achieve the above-mentioned objects, a combustor in accordance with the present invention is characterized by including: a pilot puzzle which is installed in the center portion of the combustor main body; a plurality of main nozzles which are installed around the circumference of the pilot nozzle, being equally spaced; a pilot cone which covers the downstream-side tip portion where the fuel of the pilot nozzle flows and which has the tip portion thereof provided with a tapered portion of the inner circumference of a cone that is shaped to be tapered in a radial pattern toward the downstream side; and pilot swirls which are installed so as to be in contact with the inner wall surface of the pilot cone and to support the pilot nozzle in the center portion of the pilot cone, wherein the fuel is injected therein from the fuel injection ports being provided to the outer circumference of the pilot nozzle tip to inject the fuel bump against the inner wall surface of the tapered portion of the inner circumference of a cone from the position being half as long as the tapered portion of the inner circumference of a cone to the downstream-side tip.

Additionally, the combustor in accordance with the present invention is characterized by including: a pilot puzzle which is installed in the center portion of the combustor main body; a plurality of main nozzles which are installed around the circumference of the pilot nozzle, being equally spaced; a pilot cone which covers the downstream-side tip portion where the fuel of the pilot nozzle flows and which has the tip portion thereof provided with a tapered portion of the inner circumference of a cone that is shaped to be tapered in a radial pattern toward the downstream side; and pilot swirls which are installed so as to be in contact with the inner wall surface of the pilot cone and to support the pilot nozzle in the center portion of the pilot cone; and is characterized by that when the opening angle of the pilot cone is "θ," the injection angle of the fuel being injected from the fuel injection ports being provided to the outer circumference of the tip of the pilot nozzle so as to inject the fuel is "θ/2," wherein, the fuel is injected in parallel with the inclination of the tapered portion of the inner circumference of a cone.

Moreover, the combustor in accordance with the present invention is characterized by including: a pilot nozzle which is installed in the center portion of the combustor main body; a plurality of main nozzles which are installed around the circumference of the pilot nozzle, being equally spaced; a pilot cone which covers the downstream-side tip portion where the fuel of the pilot nozzle flows; and pilot swirls which are installed so as to be in contact with the inner wall surface of the pilot cone and to support the pilot nozzle in the center portion of the pilot cone. The combustor is characterized by including: a first fuel supply channel having a large part of the fuel being installed in the center portion of the pilot nozzle and being supplied to the pilot nozzle pass through; a second fuel supply channel being installed around the first fuel supply channel and having the remaining fuel being supplied to the pilot nozzle pass through; a cylindrical pilot nozzle cover whose outer wall surface is in contact with the inner wall surface of the pilot swirls, covering the downstream-side tip of the pilot nozzle and leading the air passing through the outer circumference of the pilot nozzle to the downstream-side tip of the pilot nozzle; a first fuel injection pipe being installed to the outer circumference of the downstream-side tip of the pilot nozzle, penetrating through the pilot nozzle cover from the first fuel supply channel and injecting the fuel being supplied from the first fuel supply channel to the outer circumference of the pilot nozzle cover; and fuel injection ports being provided to the upstream side to the first fuel injection pipe on the outer circumference of the pilot nozzle, being connected to the second fuel supply channel, and injecting the fuel being supplied from the second fuel supply channel to the region, consisting of the pilot nozzle cover and the pilot nozzle.

In addition, the combustor in accordance with the present invention is characterized by including: a pilot puzzle which is installed in the center portion of the combustor main body; a plurality of main nozzles which are installed around the circumference of the pilot nozzle, being equally spaced; a pilot cone which covers the downstream-side tip portion where the fuel of the pilot nozzle flows; pilot swirls which are installed so as to be in contact with the inner wall surface of the pilot cone and to support the pilot nozzle in the center portion of the pilot cone; and a cylinder which is in contact with the downstream-side surfaces of the pilot swirls and comes close to the outer wall surface of the pilot nozzle being located downstream side to the pilot swirls and has a tip portion thereof equipped with a collar being tapered so as to be formed in a radial pattern toward the downstream side.

Furthermore, the combustor in accordance with the present invention is characterized by including: a pilot puzzle which is installed in the center portion of the combustor main body; and a bypass pipe which is connected to a bypass valve bypassing the air being not used for combustion to the downstream side of the combustor and which is installed to the upper side of the combustor main body. Wherein, the pilot nozzle has a plurality of fuel injection ports which is installed at the positions excluding the nearest position to the bypass pipe in order to inject the fuel being supplied to the pilot nozzle and which is installed to the outer circumference of the downstream-side tip thereof.

Additionally, the combustor in accordance with the present invention is characterized by including: a pilot puzzle which is installed in the center portion of the combustor main body; and a connection pipe which is installed to the side surface of the combustor main body, propagating the flame to another combustor. Wherein, the pilot nozzle has a plurality of fuel injection ports which is installed at the positions excluding the nearest position to the connection pipe in order to inject the fuel being supplied to the pilot nozzle which is installed to the outer circumference of the downstream-side tip thereof.

Also, the combustor in accordance with the present invention is characterized by including: a pilot puzzle which is installed in the center portion of the combustor main body; and a bypass pipe which is connected to a bypass valve bypassing the air being not used for combustion to the downstream side of the combustor and which is installed to the upper side of the combustor main body. Wherein, the bypass valve is slightly opened in the state of combustion.

Additionally, the combustor in accordance with the present invention is characterized by including: a pilot puzzle which is installed in the center portion of the combustor main body; a plurality of main nozzles which are installed around the circumference of the pilot nozzle, being equally spaced; a pilot cone which covers the downstream-side tip portion where the fuel of the pilot nozzle flows; and main burners which cover the downstream-side tips of the main nozzles. Wherein, the pilot cone comprises: a tapered portion of inner circumference of a cone being formed in a tapered shape so as to stretch out in a radial pattern toward a downstream side; and a collar portion which is provided to an external periphery of a downstream-side tip of the tapered portion of inner circumference of a cone and serves as a surface being approximately vertical to axial direction of the said pilot nozzle. Wherein, an angle in axial direction to a line connecting an external periphery of a downstream-side tip of the pilot nozzle and an external periphery of downstream-side tips of the main burners is specified as "αx," an opening angle of the tapered portion of inner circumference of a cone "θ" is "$0 \leqq \theta < 2\alpha x$."

Moreover, the combustor in accordance with the present invention is characterized by including: a pilot puzzle which is installed in the center portion of the combustor main body; a plurality of main nozzles which are installed around the circumference of the pilot nozzle, being equally spaced; a pilot cone which covers the downstream-side tip portion where the fuel of the pilot nozzle flows; and main burners which cover the downstream-side tips of the main nozzles. Wherein, the pilot cone comprises: a tapered portion of inner circumference of a cone being provided to downstream-side tip portion and being formed to be tapered, extending in a radial pattern to proximity of downstream-side tips of the main burners, a first cylindrical portion protruding from an external periphery of downstream-side tip of the tapered portion of inner circumference of a cone to centers of the main burners; a second cylindrical portion protruding from an external periphery of downstream-side tip of the tapered portion of inner circumference of a cone to centers of the main burners: and a cylinder being formed so as to be along an outer wall of the tapered portion of inner circumference of a cone and have downstream-side tip thereof be in contact with downstream-side tips of the main burners.

Furthermore, the combustor in accordance with the present invention is characterized by including: a pilot puzzle which is installed in the center portion of the combustor main body; a plurality of main nozzles which are installed around the circumference of the pilot nozzle, being equally spaced; a pilot cone which covers the downstream-side tip portion where the fuel of the pilot nozzle flows; and main burners which cover the downstream-side tips of the main nozzles. Wherein the pilot cone is installed to the downstream-side tip portion, and is also characterized by including: a first cylindrical portion which protrudes in the direction of the center of the main burners from the tapered portion of the inner circumference of the tapered cone spreading in a radial pattern close to the downstream-side tips of the main burners and from the outer edge of the downstream-side tip of the tapered portion of the inner circumference of a cone; a second cylindrical portion which protrudes in the direction of the center of the pilot burner from the outer edge of the downstream-side tip of the tapered portion of the inner circumference of a cone; and a cylinder being formed so as to be along the outer wall of the tapered portion of the inner circumference of a cone and having the downstream-side tip thereof get in contact with the downstream-side tips of the main burners.

DETAILED DESCRIPTION OF THE INVENTION

Figure 20:
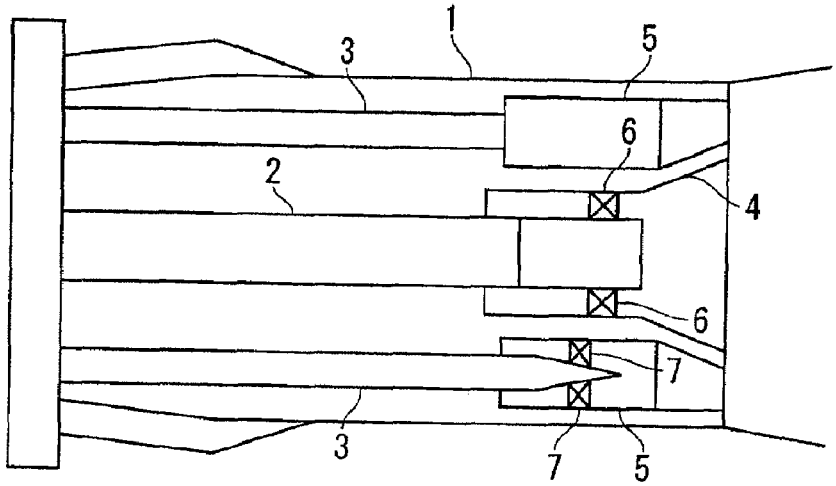
FIG.20 PRIOR ART
FIG. 20 is a schematic block diagram showing a construction of a combustor.

Referring now to the drawings, a combustor of the present invention will be described hereinafter. In each embodiment to be described hereinafter, outline of the relationship of each of portions constituting a combustor is expressed by a schematic block diagram of FIG. 20 in the same manner as is conventionally done. Therefore, construction of vicinity of a tip of a pilot nozzle which is a characteristic aspect of the present invention will be described in details hereinafter.

FIRST EMBODIMENT

Figure 1:
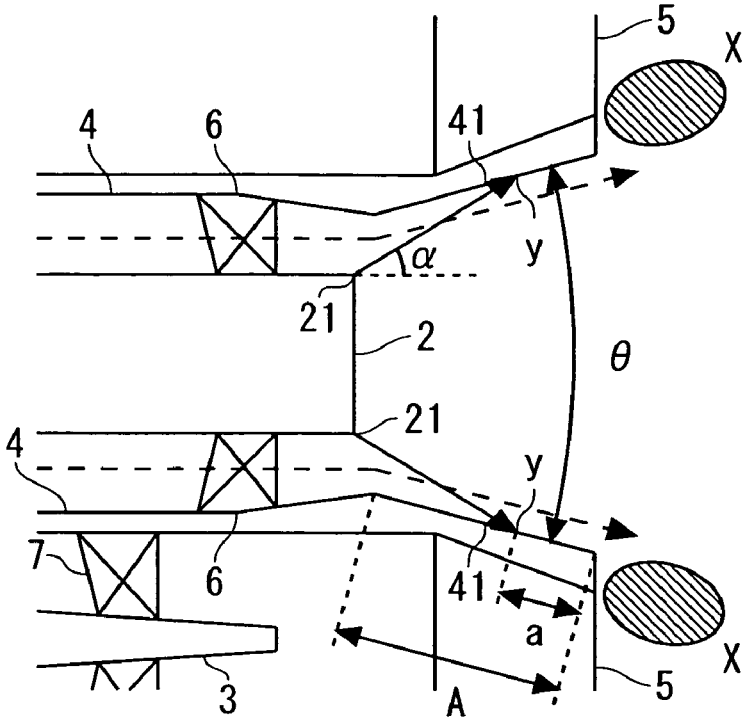
FIG. 1 is a figure showing a construction of a tip of a pilot nozzle of a combustor in accordance with a first embodiment of the prevent invention.
Figure 21:
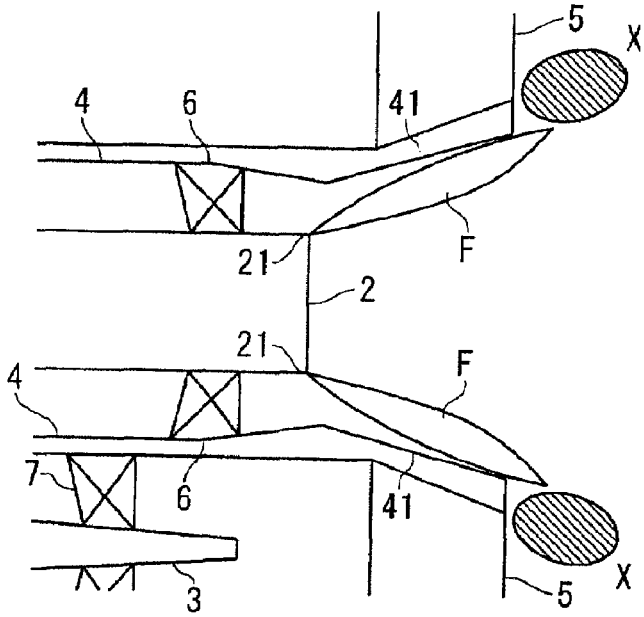
FIG.21 PRIOR ART
FIG. 21 is a figure showing a construction of a tip of a pilot nozzle of a conventional combustor.
Figure 22:
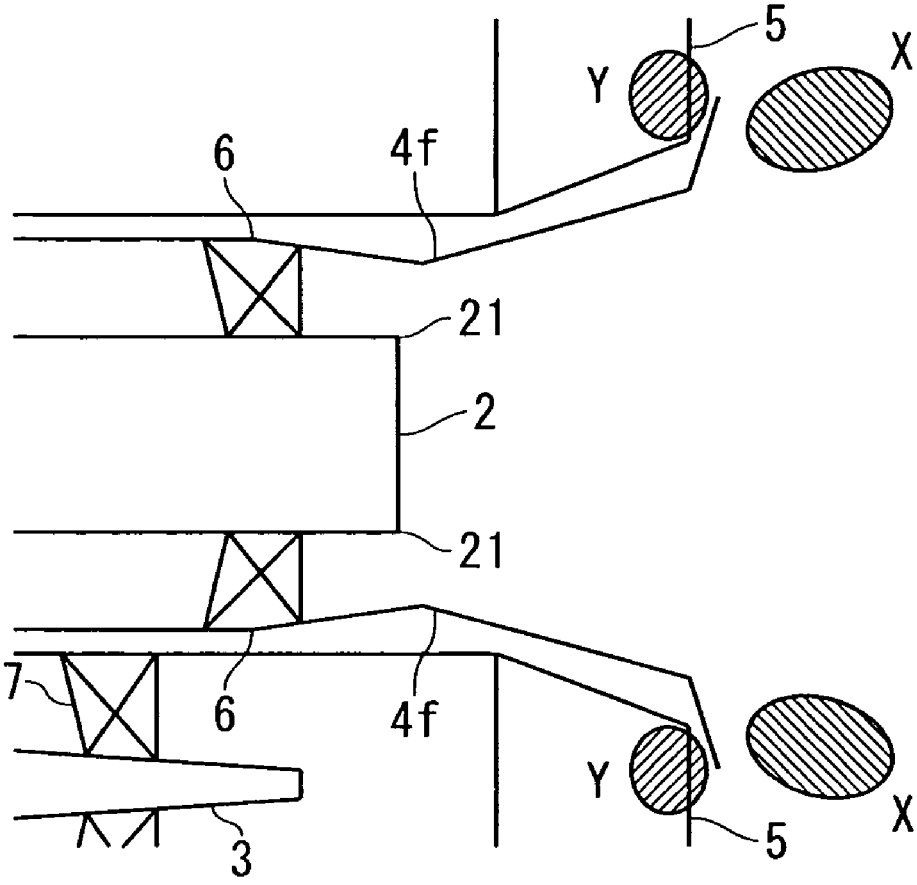
FIG. 22 a figure showing a construction of a tip of a pilot nozzle of a conventional combustor

A first embodiment of the present invention will be described by referring to a figure. FIG. 1 shows a construction of a tip of a pilot nozzle of a combustor in accordance with a first embodiment of the present invention. In FIG. 1, same symbols will be used for the same portions in FIG. 21.

A combustor of FIG. 1 has a pilot nozzle 2, having downstream-side tip thereof covered by a pilot cone 4, installed to the center portion of a combustor main body 1 (FIG. 20) and has a plurality of main nozzles 3, having downstream-side tips thereof covered by main burners 5, installed around the pilot nozzle 2. Then, by having pilot swirls 6 installed to the downstream-side outer wall surface of the pilot nozzle 2 the pilot nozzle 2 is supported so as to be placed in the center portion of a pilot cone 4. Additionally, by having main swirls 7 installed to the downstream-side outer wall surface of the main nozzle 3, the main nozzle 3 is supported so as to be placed in the center of the main burners 5.

Constructed as mentioned hereinabove, the pilot cone 4 is formed so as to be tapered, spreading in a radial pattern toward the downstream-side tip thereof (The portion which spreads in a radial pattern will be referred as a "tapered portion of the inner circumference of a cone" hereinafter.) By having the tapered portion of the inner circumference of a cone 41 shaped so as to spread in a radial pattern, the pilot fuel being injected from the fuel injection ports 21 being installed to the outer circumference of the tip of the pilot nozzle 2 and the pilot air flowing through the pilot swirls 6 are introduced to a low-speed flame-stabilizing zone "X" serving as the periphery of the tapered portion of the inner circumference of a cone 41, being located in the proximity of the downstream-side tips of the main burners 5.

Additionally, when the opening angle of the tapered portion of the inner circumference of a cone 41 is "θ," the spray angle "α" of the pilot fuel being injected from the fuel injection ports 21 is specified to be $-90° \leqq \alpha < -\theta/2$ and $\theta/2 < \alpha \leqq 90°$. By specifying as mentioned hereinabove, in case of "$-90° \leqq \alpha < \theta/2$," the fuel bumps, on the side opposite to where the respective fuel injection port 21 are located with respect to the center of the pilot nozzle 2, against the inner wall of the tapered portion of the inner circumference of a cone 41; and in case of "$\theta/2 < \alpha \leqq 90°$," the fuel hits against the inner wall of the tapered portion of the inner circumference of a cone 41 which is close to the portion where the respective fuel injection ports 21 are located.

Furthermore, the length "a" along the inner wall surface of the tapered portion of the inner circumference of a cone 41 from the position "y" where the pilot fuel bumps against the inner wall of the tapered portion of the inner circumference of a cone 41 to the downstream-side tip of the pilot cone 4 satisfies the relation of "$0 < a \leqq A/2$" for the length "A" along the entire inner wall surface of the tapered portion of the inner circumference of a cone 41. To put it plainly, the spray angle "α" and the position of the downstream-side tip of the pilot nozzle 2 are determined in a manner that the bumping position "y" of the pilot fuel on the inner wall of the tapered portion of the inner circumference of a cone 41 will be located within the range from the center of the tapered portion of the inner circumference of a cone 41 to the downstream-side tip thereof. At this time, the pilot nozzle 2 is installed so as to have the position of the tip of the pilot nozzle 2 located within the range between the downstream-side tip of the pilot cone 4 and the downstream-side surfaces of the pilot swirls 6.

As described hereinabove, because the pilot fuel bumps between the center of the pilot cone 4 and the downstream side, the pilot fuel burns from the bumping position "y" along the tapered shape of the tapered portion of the inner circumference of a cone 41 of the pilot cone 4. Therefore, it becomes easy for the pilot flame to be introduced to the low-speed flame-stabilizing zone "X." In consequence, although the pilot fuel is reduced, it is possible to enhance flame stability in the low-speed flame-stabilizing zone "X."

Based on the above, because the air-fuel pre-mixture having the main fuel being injected from the main nozzle 3 mixed in the main burners 5 with the main air passing through the main swirls 7 burns stably with the low-speed flame-stabilizing zone "X" serving as the flame-stabilizing point, it is possible to burn the air-fuel pre-mixture stably. Therefore, because it is possible to restrain combustion vibrations from occurring when the air-fuel pre-mixture is burned, combustion vibrations can be restrained by stabilizing combustion in a combustor although the pilot ratio is lowered by decreasing the pilot fuel.

Additionally, the closer to the downstream-side tip of the pilot cone 4 the bumping position "y" of the pilot fuel is, the more pilot fuel reaches the low-speed zone flame-stabilizing "X," so that the flame stability in the low-speed flame-stabilizing zone "X" will be improved. Consequently, in the above-mentioned region, combustion vibrations in a combustor can be restrained when the pilot ratio is small, by specifying the position of the downstream-side tip of the pilot nozzle 2 and the spray angle of the pilot fuel so as to make the bumping position "y" of the pilot fuel come close to the downstream-side tip of the pilot cone 4.

SECOND EMBODIMENT

Figure 2:
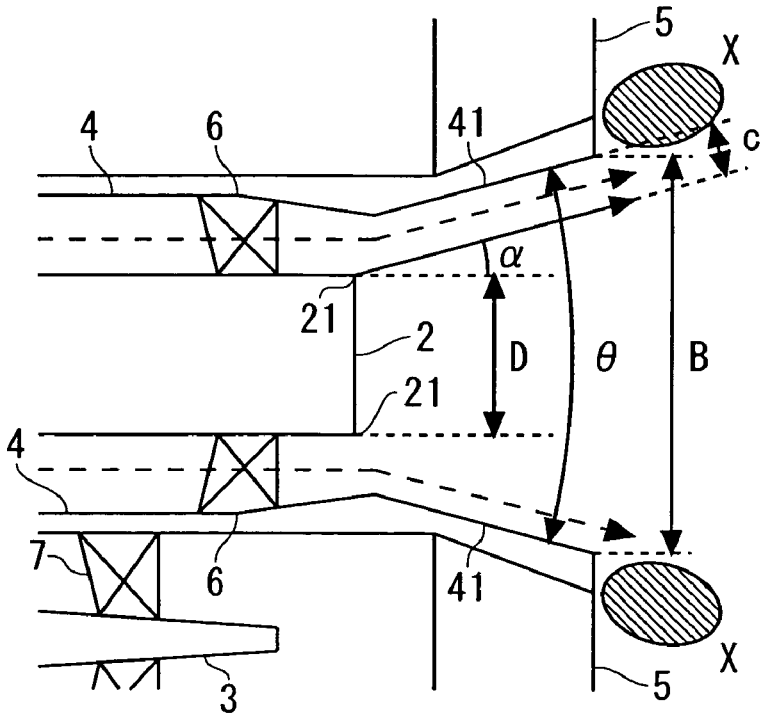
FIG. 2 is a figure showing a construction of a tip of a pilot nozzle of a combustor in accordance with a second embodiment of the prevent invention.

A second embodiment of the present invention will be described by referring to figures. FIG. 2 shows the construction of a tip of a pilot nozzle of the combustor in accordance with the second embodiment of the present invention. In FIG. 2, same symbols will be used for the same portions in FIG. 1. Additionally, the combustor in accordance with the second embodiment of the present invention consists of the same components as the combustor in accordance with the first embodiment (FIG. 1), but the set value of the spray angle "α" of the pilot fuel differs. Therefore, the portions being related to the spray angle "α" of the pilot fuel will be described in details hereinafter.

Being different from the combustor in FIG. 1, in a combustor in FIG. 2, the spray angle "α" of the pilot fuel from fuel injection ports 21 is specified as "θ/2." To put it plainly, the pilot fuel is injected in parallel with the inner wall surface of the tapered portion of the inner circumference of a cone 41. By having the pilot fuel injected in parallel with the inner wall surface of the tapered portion of the inner circumference of a cone 41 from the fuel injection ports 21 as described hereinabove, the pilot fuel burns, thereby making it easy for the pilot flame to be introduced to the low-speed flame-stabilizing zone "X." Consequently, although the pilot fuel is decreased, it is possible to enhance flame stability in the low-speed flame-stabilizing zone "X."

Additionally, it is desirable to make the distance "c" between the injecting direction of the pilot fuel and the inner wall surface of the tapered portion of the inner circumference of a cone 41 be "½ (B−D)," where the diameter at the downstream-side tip of the pilot cone 4 is "B" and the diameter of the pilot nozzle 2 is "D." Furthermore, it is more desirable to make the distance "c" be 20 mm or less. In addition, at this time, the pilot nozzle 2 is installed in such a manner as the position of the tip of the pilot nozzle 2 is located within the range between the downstream-side tip of the pilot cone 4 and the downstream-side surfaces of the pilot swirls 6.

Figure 3:
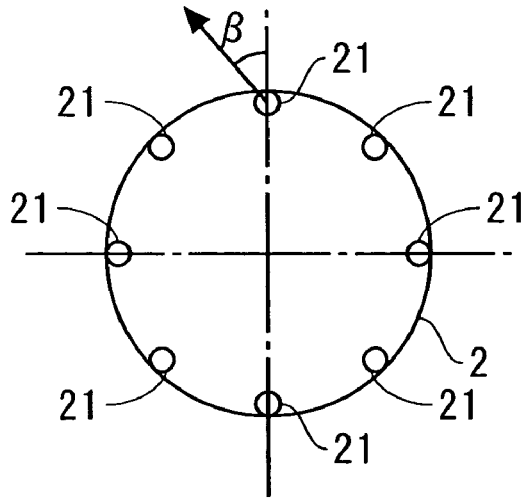
FIG. 3 is a figure of a pilot nozzle viewed from the downstream-side tip thereof.

As shown in FIG. 3, in the first and the second embodiments of the present invention, when the pilot nozzle 2 is viewed from the downstream side, the pilot fuel may not be injected from the fuel injection ports 21 in a radial pattern but may be injected at an angle drifting from the direction toward the fuel injection ports 21 from the center of the pilot nozzle 2 for an angle "β" (laterally-facing angle "β"). At this time, the pilot fuel flows in a spiral along the inner wall surface of the tapered portion of the inner circumference of a cone 41.

THIRD EMBODIMENT

Figure 4:
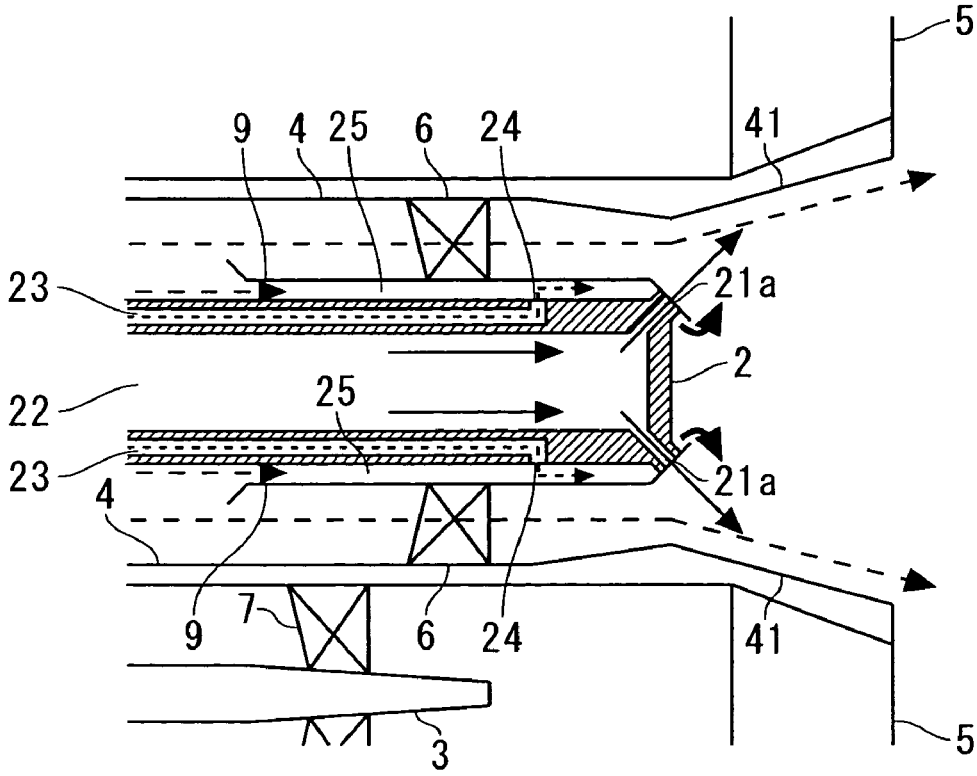
FIG. 4 is a figure showing a construction of a tip of a pilot nozzle of a combustor in accordance with a third embodiment of the prevent invention.

A third embodiment of the present invention will be described by referring to a figure. FIG. 4 shows the construction of a tip of a pilot nozzle of the combustor in accordance with the third embodiment of the present invention. In FIG. 4, same symbols will be used for the same portions in FIG. 1, and detailed explanation thereof will be omitted.

A combustor in FIG. 4 has a cylindrical pilot nozzle cover 9 installed, covering the downstream-side tip of the pilot nozzle 2 from more upstream side than the pilot swirls 6. To put it simply, the pilot nozzle cover 9 is inserted and placed so as to be in contact with the inner wall surfaces of the pilot swirls 6. Additionally, inside the pilot nozzle 2, a main fuel supply channel 22 to which most of the pilot fuel is supplied is installed in the center thereof, and a flame-stabilizing fuel supply channel 23 to which the remaining pilot fuel is supplied is installed to the outer circumference of the main fuel supply channel 22.

Moreover, fuel injection pipes 21*a* that are installed to the outer circumference of the downstream-side tip of the pilot nozzle 2 and injects the pilot fuel being provided through the main fuel supply channel 22 are provided so as to penetrate through the pilot nozzle cover 9; and flame-stabilizing fuel injection ports 24 which inject the pilot fuel being supplied through the flame-stabilizing fuel channel 23 are installed to the outer wall surface of the pilot nozzle 2 on the more upstream side than the fuel injection pipes 21*a*. By making the fuel injection orifices 21 (FIG. 1) serve as fuel injection pipes 21*a*, the pilot fuel being supplied through the main fuel supply channel 22 can be injected without having the sweep air mixed therein.

When the combustor is constructed as mentioned hereinabove, a part of the pilot air flowing on the side of outer circumference of the pilot nozzle 2 flows through a sweep air supply pathway 25 consisting of the pilot nozzle 2 and the pilot nozzle cover 9, serving as the sweep air which prevents the fuel injection pipes 21*a* from being burned, and a large part of the remaining pilot air passes through the pilot swirls 6. Additionally, the sweep air is mixed with the pilot fuel being injected from the flame-stabilizing fuel injection ports 24 and the air-fuel pre-mixture is discharged from the downstream-side tip of the sweep air supply pathway 25.

Here, the surrounding areas of the fuel injection pipes 21*a* are cooled by the air-fuel pre-mixture going through the sweep air supply pathway 25, thereby preventing the vicinity of the fuel injection pipes 21*a* from being burned. In order to prevent the vicinity of the fuel injection pipes 21*a* from being burned as mentioned hereinabove, the flow volume of the pilot fuel flowing through the flame-stabilizing fuel supply channel 23 is set so that the pilot fuel will be dilute in density, wherein the combustion gas temperature of the air-fuel pre-mixture is 1500° C. or less. When the air-fuel pre-mixture obtains such density as the combustion gas temperature is higher than 1500° C., there is a concern of occurrence of flashback. In addition, the pilot fuel flowing through the main fuel supply channel 22 is injected to the outside of the pilot nozzle cover 9 from the fuel injection pipes 21*a*.

Because the air-fuel pre-mixture is discharged from the downstream-side tip of the sweep air supply pathway 25 when the pilot fuel being injected from the fuel injection pipes 21*a* is diffused and burned, it is possible to enhance flame stability of the pilot diffusion flame by the pilot fuel from the fuel injection pipes 21*a*. Therefore, because the flame stability of the air-fuel pre-mixture being mixed by the main burners 5 and burned by the pilot diffusion flame can also be enhanced, it is possible to restrain the combustion vibrations by making combustion in a combustor stable although the pilot ratio is lowered.

FOURTH EMBODIMENT

Figure 5:
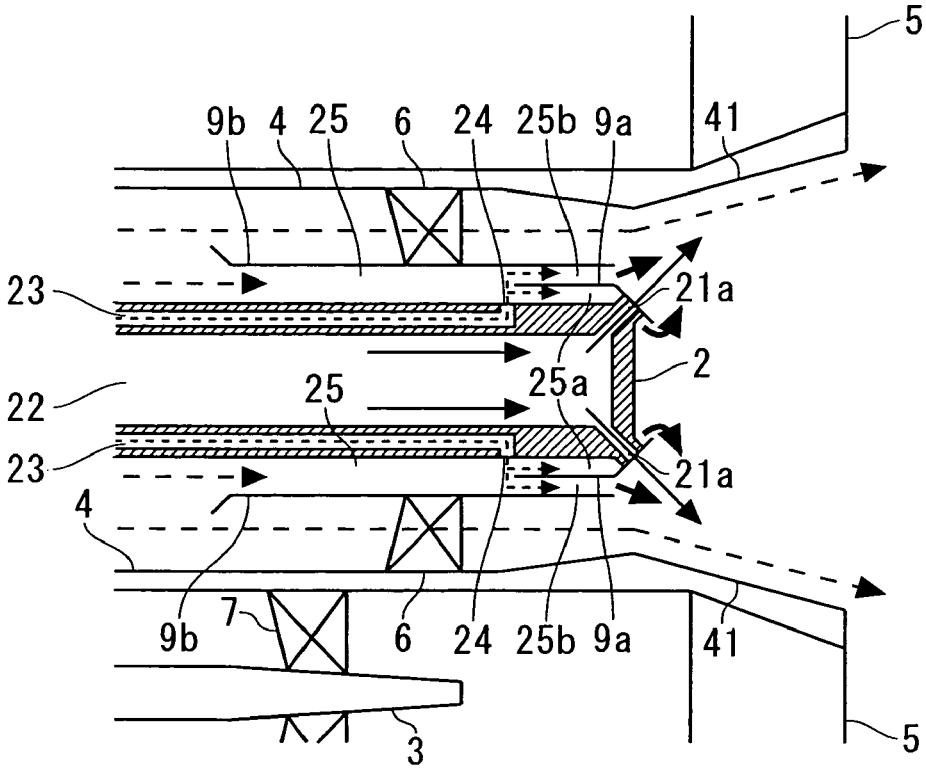
FIG. 5 is a figure showing a construction of a tip of a pilot nozzle of a combustor in accordance with a fourth embodiment of the prevent invention.

A fourth embodiment of the present invention will be described by referring to a figure. FIG. 5 shows the construction of a tip of a pilot nozzle of the combustor in accordance with the fourth embodiment of the present invention. In FIG. 5, same symbols will be used for the same portions in FIG. 4, and detailed explanation thereof will be omitted.

Being different from the combustor in accordance with the third embodiment (FIG. 4), the combustor shown in FIG. 5 is provided with a cylindrical pilot nozzle cover 9*a* covering the portion from the proximity of flame-stabilizing fuel injection ports 24 of the pilot nozzle 2 to the downstream-side tip thereof and a cylindrical pilot nozzle cover 9*b* being installed to the outer circumference side of the pilot nozzle cover 9*a*. Additionally, the pilot nozzle cover 9*b* is installed so as to be in contact with the inner wall surface of the pilot swirls 6 and to overlap the pilot nozzle cover 9*a* on the upstream side of the fuel injection pipes 21*a*. Furthermore, the pilot nozzle cover 9*b* is provided so as to cover the pilot nozzle 2 from the upstream side of the pilot swirls 6.

By installing the pilot nozzle covers 9*a* and 9*b* as mentioned hereinabove, the sweep air flows through the sweep air supply pathway 25 consisting of the pilot nozzle 2 and the pilot nozzle cover 9*b* and is mixed with the pilot fuel being injected from the flame-stabilizing fuel injection ports 24. The air-fuel pre-mixture being a mixture of the pilot fuel and the sweep air flows into the air-fuel pre-mixture supply pathway 25*a* consisting of the pilot nozzle 2 and the pilot nozzle cover 9*a* and into the air-fuel pre-mixture supply pathway 25*b* consisting of the pilot nozzle covers 9*a* and 9*b*, respectively.

Then, the air-fuel pre-mixture flowing through the air-fuel pre-mixture pathway 25*b* to be discharged is discharged to downstream side of the fuel injection pipes 21*a*, and the air-fuel pre-mixture flowing through the air-fuel pre-mixture supply pathway 25*b* to be discharged is discharged to the upstream side of the fuel injection pipes 21*a*. Therefore, because the pilot fuel being injected from the fuel injection pipes 21*a* can be wrapped by the air-fuel pre-mixture, the air-fuel pre-mixture can be supplied so as to wrap up the pilot diffusion flame, thereby enhancing the flame stability of the pilot diffusion flame.

FIFTH EMBODIMENT

Figure 6:
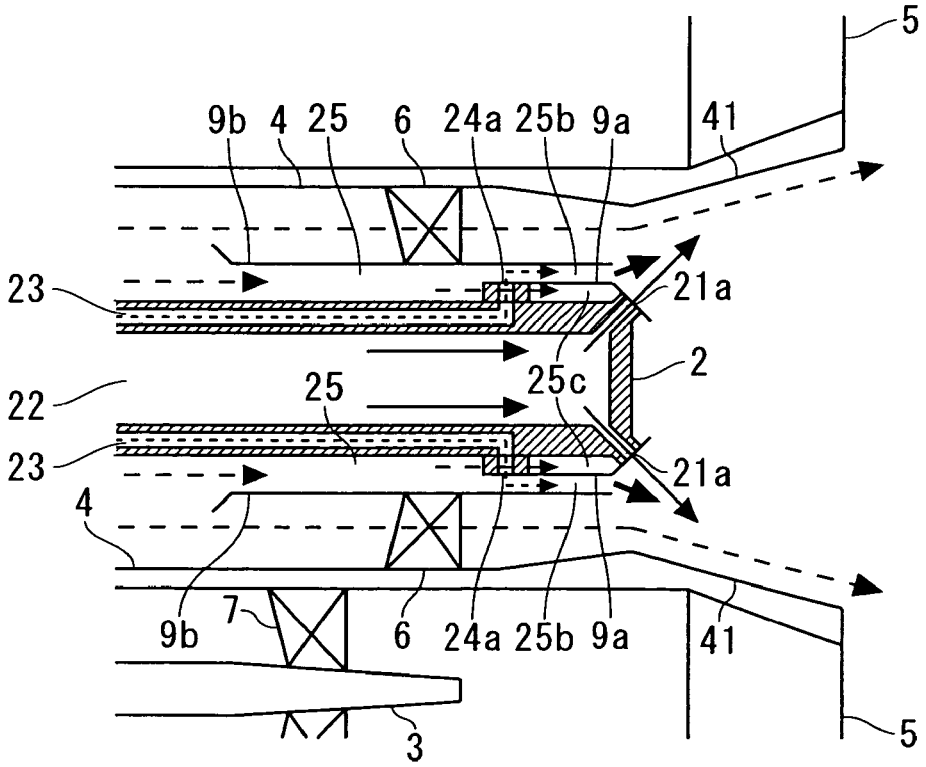
FIG. 6 is a figure showing a construction of a tip of a pilot nozzle of a combustor in accordance with a fifth embodiment of the prevent invention.

A fifth embodiment of the present invention will be described by referring to a figure. FIG. 6 shows the construction of a tip of a pilot nozzle of the combustor in accordance with the fifth embodiment of the present invention. In FIG. 6, same symbols will be used for the same portions in FIG. 5, and detailed explanation thereof will be omitted.

Being different from the combustor in accordance with the fourth embodiment (FIG. 5), in the combustor in FIG. 6, a flame-stabilizing fuel injection pipe 24*a* injecting the pilot fuel being supplied from the flame-stabilizing fuel supply channel 23 is provided in such a manner as to penetrate through the pilot nozzle cover 9*a*. By having the flame-stabilizing fuel injection ports 24 (FIG. 5) serve as the flame-stabilizing fuel injection pipe 24*a*, the sweep air flowing through the sweep air supply pathway consisting of the pilot nozzle 2 and the pilot nozzle cover 9*a* can flow without being mixed with the pilot fuel being supplied through the flame-stabilizing fuel supply channel 23.

By installing the flame-stabilizing fuel injection pipe 24*a* as mentioned hereinabove, the sweep air being supplied from the sweep air supply pathway 25 and flowing through the sweep air supply pathway 25*c* is discharged to the downstream-side tip of the pilot nozzle 2 without being mixed with the pilot fuel. Consequently, it is ensured that the downstream-side tip of the pilot nozzle 2 is cooled by the sweep air.

Moreover, the sweep air flowing into the air-fuel pre-mixture supply pathway 25*b* consisting of the pilot nozzle covers

9*a* and 9*b* is mixed with the pilot fuel being injected from the flame-stabilizing fuel injection pipe 24*a* and discharged to the upstream side of the fuel injection pipe 21*a* as an air-fuel pre-mixture. Consequently, because the air-fuel pre-mixture is supplied to the surrounding area of the pilot diffusion flame, the flame stability of the pilot diffusion flame can be enhanced.

In addition, in the third through the fifth embodiments of the present invention, such a combustor may be applied, wherein the relation between the spray angle of the pilot fuel being injected from the fuel injection pipe 21*a* and the tapered portion of the inner circumference of a cone 41 of the pilot cone 4 is such as the relation in the first or the second embodiment.

SIXTH EMBODIMENT

Figure 7:
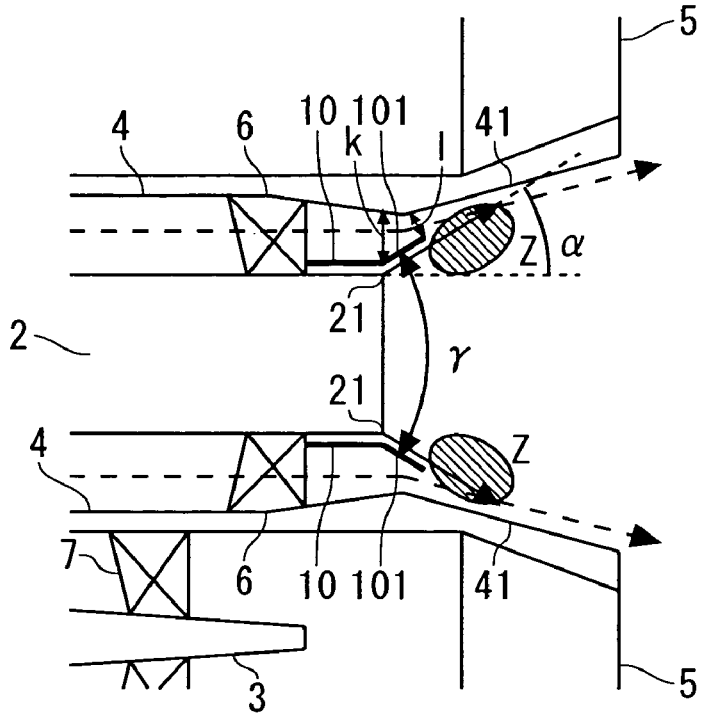
FIG. 7 is a figure showing a construction of a tip of a pilot nozzle of a combustor in accordance with a sixth embodiment of the prevent invention.
Figure 8:
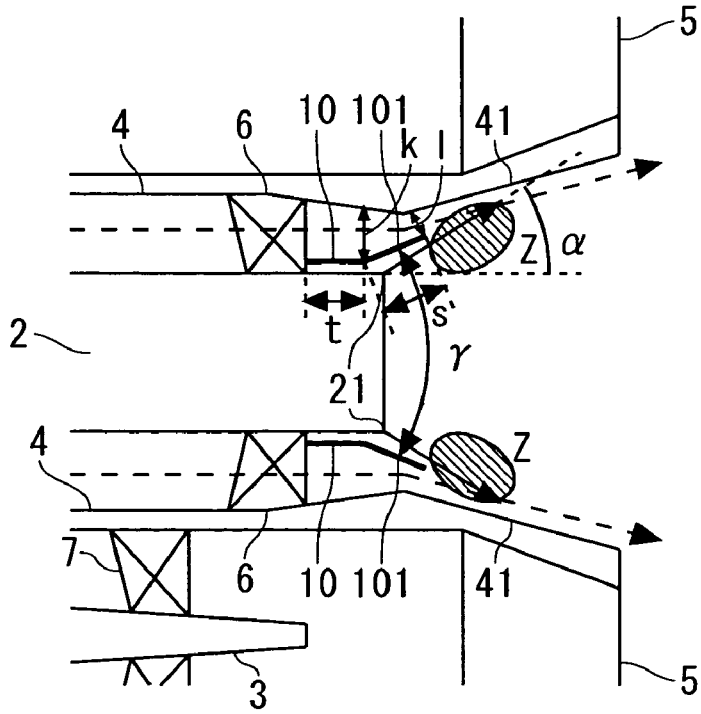
FIG. 8 is a figure showing another construction of a tip of a pilot nozzle of a combustor in accordance with a sixth embodiment of the present invention.

A sixth embodiment of the present invention will be described by referring to a figure. FIG. 7 and FIG. 8 show the construction of a tip of a pilot nozzle of the combustor in accordance with the sixth embodiment of the present invention. In FIG. 7 and FIG. 8, same symbols will be used for the same portions in FIG. 1, and detailed explanation thereof will be omitted.

The combustor in FIG. 7 and FIG. 8 is provided with a cylinder 10 covering the downstream-side tip portion of the pilot nozzle 2 from the downstream-side surfaces of the pilot swirls 6. The cylinder 10 is constructed in a manner that the inner wall surface thereof is in close contact with the outer wall surface of the pilot nozzle 2 in the section from the downstream-side surfaces of the pilot swirls 6 to the downstream-side tip of the pilot nozzle 2. At this time, a narrow space is provided between the section of the cylinder 10 being adjacent to the outer wall surface of the pilot nozzle 2 and the outer wall surface of the pilot nozzle 2. Additionally, the cylinder 10 is provided with a collar 101 which spreads out from the location in the proximity of the downstream-side tip of the pilot nozzle 2 toward the downstream, being formed so as to be tapered. Because the cylinder 10 being provided with the collar 101 is installed so as to be in contact with the downstream-side surfaces of the pilot swirls 6, the pilot air passing through the pilot swirls 6 passes between the pilot cone 4 and the cylinder 10.

Additionally, the collar 101 of the cylinder 10 is so constructed as not to interfere with the jet flow of the pilot fuel being injected from the fuel injection ports 21. In order to be constructed so as to prevent interference with the jet flow of the pilot fuel as mentioned hereinabove, for example, as shown in FIG. 7, the opening angle "$\gamma$" of the collar 101 being relative to the spray angle "$\alpha$" of the pilot fuel from the fuel injection ports 21 may be "$0°<2\alpha\leqq\gamma<180°$." Moreover, in order that the pilot air passes between the pilot cone 4 and the cylinder 10 sufficiently, being relative to the distance "k" between the inner wall surface of the pilot cone 4 and the outer wall surface of the pilot nozzle 2 at the position of the downstream-side tip of the pilot nozzle 2, the distance "1" between the inner wall surface of the pilot cone 4 and the collar 101 at the position of the downstream-side tip of the cylinder 10 is specified to be "$0<1\leqq k$," or more preferably, to be "$1\geqq k/2$."

In addition, for example, as shown in FIG. 8, when the collar 101 is formed at the position drifting slightly toward the upstream side from the downstream-side tip of the pilot nozzle 2 and when the opening angle "$\gamma$" of the collar 101 is "$0°<\gamma<2\alpha$," wherein the distance between the position where the collar 101 starts to be formed and the downstream-side tip of the pilot nozzle 2 is "t," the length "s" of the collar 101 may be set so as to satisfy "$s<t/(\cos(\gamma/2)—\tan\alpha\times\sin(\gamma/2))$," "thereby preventing the pilot fuel being injected from the fuel injection ports 21 from bumping against the collar 101.

Because vortex of the pilot fuel is formed in the vicinity "Z" at the tip portion of the collar 101 when the pilot fuel flows along the collar 101 of the cylinder 10 due to construction as mentioned hereinabove, a circulation area serving as a low-speed zone is formed. Consequently, because the pilot fuel does not hit against the base of the jet flow of the pilot fuel in the surrounding area of the fuel injection ports 21, it is possible to prevent the pilot diffusion flame from weakening; and in addition, because a circulation area is formed in the vicinity "Z" of the tip portion of the collar 101, the pilot diffusion flame can be burned stably.

SEVENTH EMBODIMENT

Figure 9:
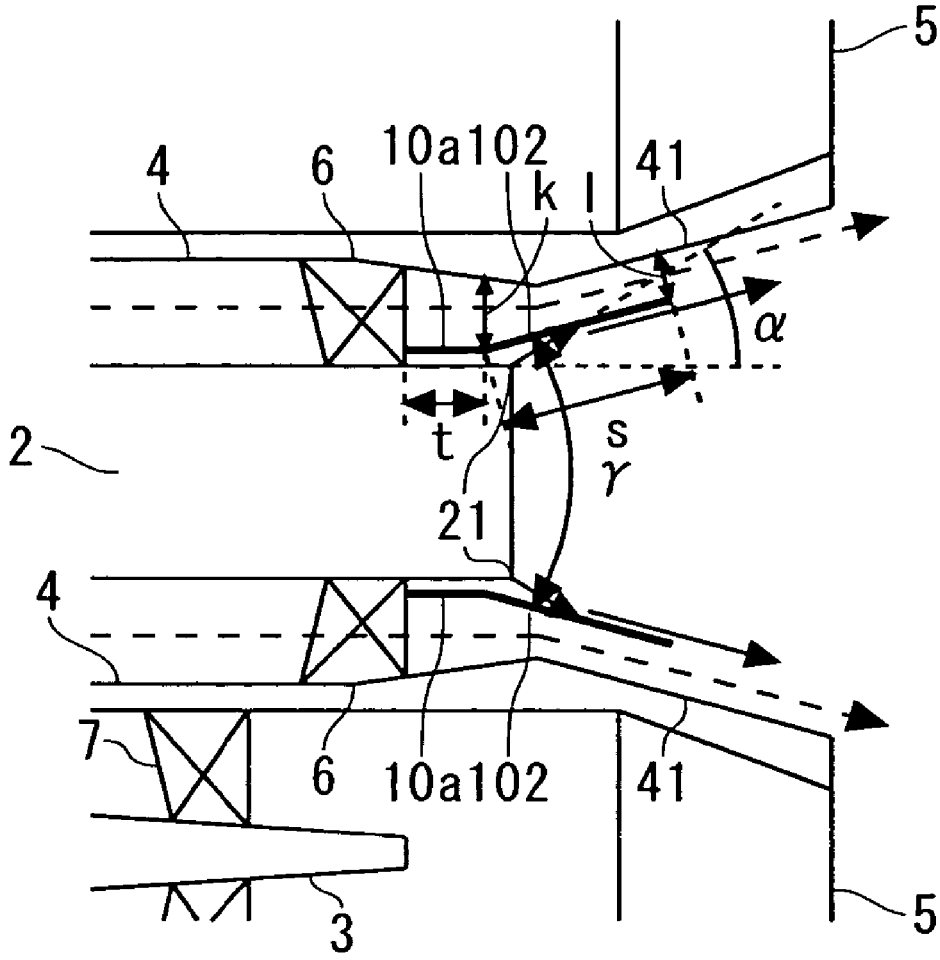
FIG. 9 is a figure showing a construction of a tip of a pilot nozzle of a combustor in accordance with a seventh embodiment of the prevent invention.

A seventh embodiment of the present invention will be described by referring to a figure. FIG. 9 shows the construction of a tip of a pilot nozzle of the combustor in accordance with the seventh embodiment of the present invention. In FIG. 9, same symbols will be used for the same portions in FIG. 8, and detailed explanation thereof will be omitted.

Same as the combustor in accordance with the sixth embodiment (FIG. 8), the combustor in FIG. 8 has a cylinder 10*a* covering the downstream-side tip portion of the pilot nozzle 2 from the downstream-side surfaces of the pilot swirls 6 provided so as to be in contact with the downstream-side surfaces of the pilot swirls 6. To put it plainly, in the section from the downstream-side surfaces of the pilot swirls 6 to the downstream-side tip of the pilot nozzle 2, a narrow space is formed between the section of the cylinder 10*a* being adjacent to the outer wall surface of the pilot nozzle 2 and the outer wall surface of the pilot nozzle 2 in the cylinder 10*a*. Additionally, the cylinder 10*a* is provided with a collar 102 spreading out toward the downstream side from the position being in the proximity of the downstream-side tip of the pilot nozzle 2, being formed so as to be tapered.

Moreover, the collar 102 is formed at the position drifting slightly toward the upstream side from the downstream-side tip of the pilot nozzle 2, wherein the opening angle "$\gamma$" of the collar 102 is specified to be "$0°<\gamma<2\alpha$." Then, by setting the length "s" of the collar 102 so as to satisfy "$s\geqq t/(\cos(\gamma/2)-\tan\alpha\times\sin(\gamma/2))$," the pilot fuel being injected from the fuel injection ports 21 is made to hit against the collar 102. Additionally, in order that the pilot air can pass sufficiently between the pilot cone 4 and the cylinder 10*a*, the distance "1" between the inner wall surface of the pilot cone 4 and the collar 102 at the position of the downstream-side tip of the cylinder 10*a* is specified to be "$0<1\leqq k$," or more preferably, to be" $1\geqq/2$."

Being constructed as mentioned hereinabove, a low-speed zone is formed by a hitting point where the pilot fuel bumps in the collar 102 of the cylinder 10*a*, thereby burning the pilot fuel along the collar 102. Therefore, because the pilot air does not hit against the base of the jet flow of the pilot fuel and against the hitting point of the pilot fuel in the surrounding area of the fuel injection ports 21, the pilot diffusion flame can be prevented from weakening as well as the stability of the pilot diffusion flame is enhanced at the hitting point by the collar 102, thereby burning the pilot diffusion flame stably.

In addition, in the sixth and the seventh embodiments of the present invention, such a combustor may be applied, wherein the relation between the spray angle of the pilot fuel being injected from the pilot injection ports 21 and the tapered portion of the inner circumference of a cone 41 is such as the relation in the first or the second embodiment. Moreover, as the third through the fifth embodiments, the pilot nozzle covers 9, 9*a* and 9*b* may be installed, covering the downstream-side tip of the pilot nozzle 2.

EIGHTH EMBODIMENT

An eighth embodiment of the present invention will be described by referring to figures. FIG. 10A through FIG. 10F are schematic cross-sectional views showing the relation between the combustor body and the fuel injection ports of the pilot nozzle in accordance with the eighth embodiment.

In the combustor in FIG. 10A through FIG. 10F, the combustor body 150 is provided with an air bypass pipe 151 being connected to a bypass valve 160 consisting of a butterfly valve and the like in which the air not being used for combustion flows from the compressor, and a connection pipe 152 being connected to the other combustor body and propagating the flame. Wherein, the air bypass pipe 151 is installed to the top of the combustor body 150, and the connection pipe 152 is installed to both side surfaces of the combustor body 150.

Because the combustor body 150 is provided with the air bypass pipe 151 and the connection pipe 152 that serve as hollows, the hollow being made by each of the air bypass pipe 151 and the connection pipe 152 serves as a stagnant area of the fuel gas, respectively, when combustion is performed by the combustor. Therefore, in the areas in the proximity of the air bypass pipe 151 and the connection pipe 152, combustion becomes unstable, which in consequence, causes combustion vibrations to occur and affects combustion in other areas.

Figure 10A:
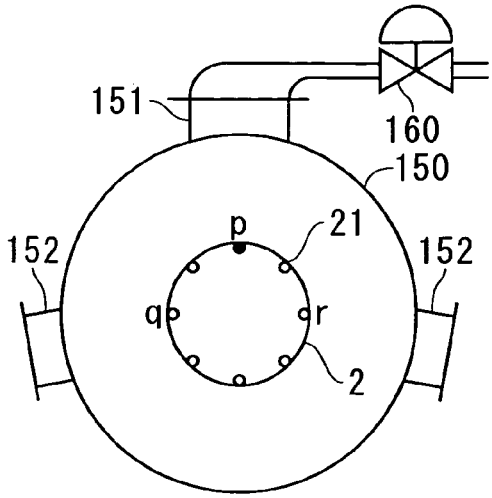
FIG. 10A through FIG. 10F are schematic cross-sectional views showing the relation between a combustor main body and fuel injection ports of a pilot nozzle in accordance with an eighth embodiment of the prevent invention.

Consequently, as shown in FIG. 10A, for an example, this embodiment is constructed in such a manner as fuel injection ports 21 are not installed to the position "p" in the pilot nozzle 2 which is nearest to the location of the bypass pipe 151. To put it plainly, for example, when seven fuel injection ports 21 are installed, among the fuel injection ports 21 being arranged so as to be equally spaced, supposing that eight fuel injection ports 21 will be installed, the fuel injection port 21 being mounted to the position "p" is plugged.

Figure 10B:
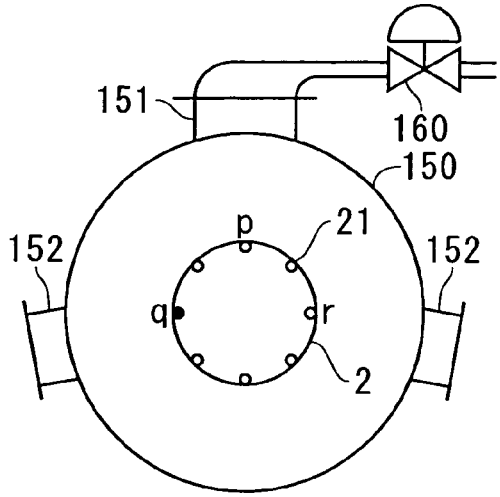
Figure 10C:
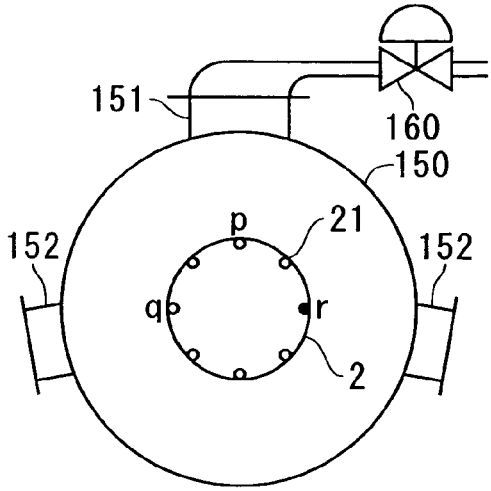
Figure 10D:
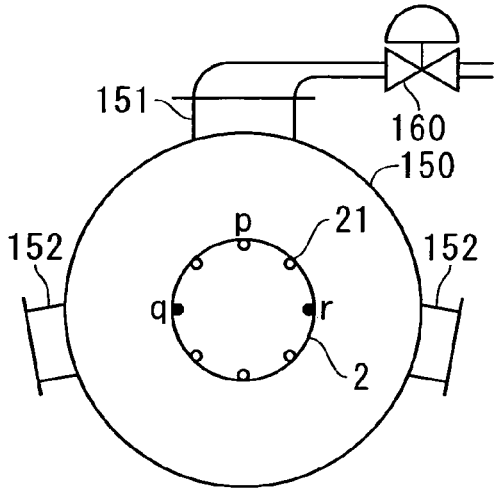
Figure 10E:
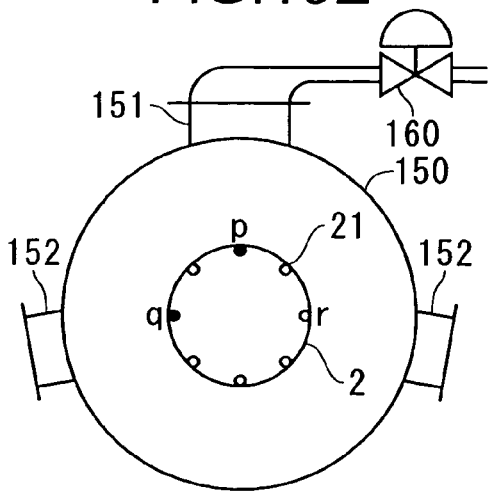
Figure 10F:
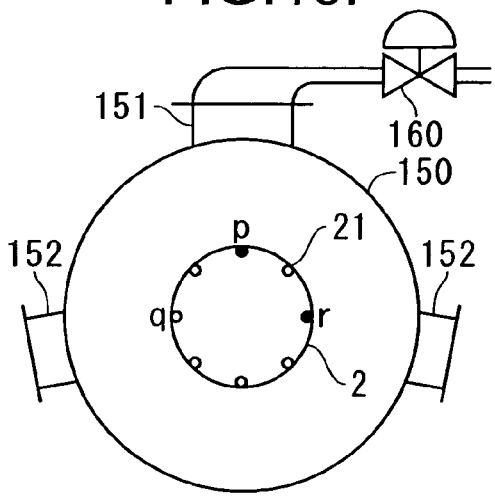

In addition, in a similar manner to the aforesaid, for another example as shown in FIG. 10B and FIG. 10C, respectively, the pilot nozzle 2 is constructed in such a manner as the fuel injection ports 21 are not installed to one of the positions "q" and "r" which are nearest to the location of the connection pipe 152. Moreover, for another example, as shown in FIG. 10D, the pilot nozzle 2 is constructed in such a manner as both positions "q" and "r" which are nearest to the location of the connection pipe 152 have no fuel injection ports 21 provided thereto. Furthermore, for another example, as shown in FIG. 10E and FIG. 10F, the pilot nozzle 2 is constructed in such a manner as fuel injection ports 21 are not installed to either of the positions "q" and "r" which are nearest to the location of the connection pipe 152 and not to the position "p" which is nearest to the location of the air bypass pipe 151.

By plugging the fuel injection ports 21 being located to the hollows being made by the air bypass pipe 151 or the connection pipe 152, it is possible to prevent the fuel gas from diffusing to the hollows being made by the air bypass pipe 151 or the connection pipe 152. As a result, stagnation of the fuel gas due to the hollows by the air bypass pipe 151 or the connection pipe 152 can be prevented, thereby restraining combustion vibrations when the pilot ratio is lowered.

Additionally, as shown in FIG. 10A, this embodiment is so constructed as to plug the fuel injection port 21 at the location corresponding to the air bypass pipe 151. However, by providing the fuel injection port 21 to the location corresponding to the air bypass pipe 151 and having the bypass valve 160 open slightly during combustion in the combustor, a small amount of the air may be supplied in a case where the load is higher than the partial load. Moreover, the construction of the combustor, wherein a small amount of the air is supplied by having the bypass valve 160 slightly open, may be applied to the combustors having a construction as shown in FIG. 10B through FIG. 10D.

Furthermore, in the combustor in accordance with this embodiment, the surrounding area of the pilot nozzle thereof may be constructed in such a manner as the first through the seventh embodiments are constructed. Wherein, the surrounding area of the pilot nozzle may have such a construction as the characteristics being described for the first through the seventh embodiments are combined.

NINTH EMBODIMENT

Figure 11:
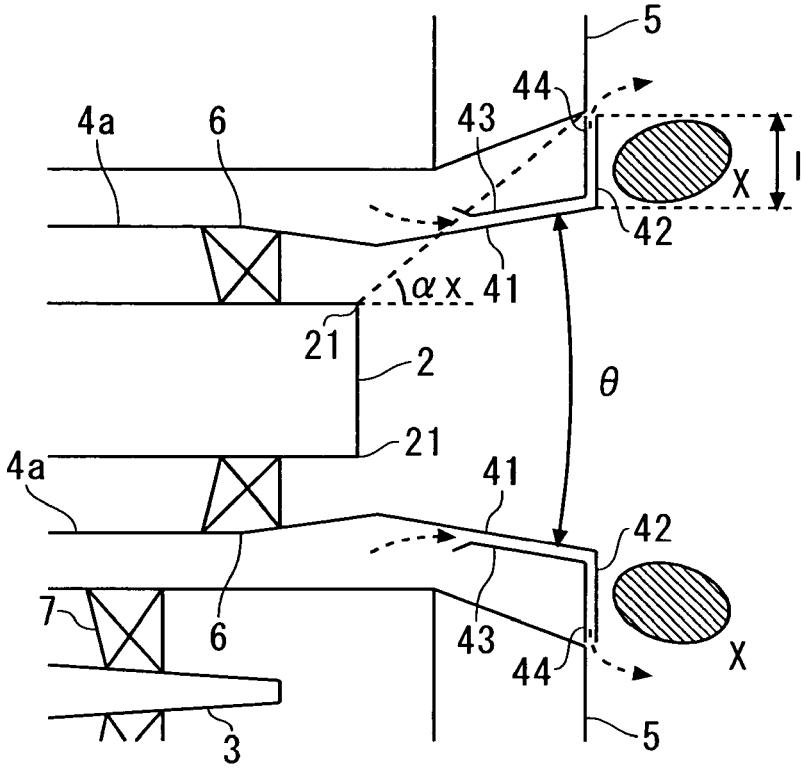
FIG. 11 is a figure showing a construction of vicinity of a tip of a pilot nozzle of a combustor in accordance with a ninth embodiment of the present invention.

A ninth embodiment of the present invention will be described by referring to a figure. FIG. 11 shows the construction of vicinity of a tip of a pilot nozzle of the combustor in accordance with the ninth embodiment of the present invention. In FIG. 11, same symbols will be used for the same portions in FIG. 1, and detailed explanation thereof will be omitted.

The combustor in FIG. 11 has a pilot nozzle 2 whose downstream-side tip is covered by a pilot cone 4*a* (being equivalent to the pilot cone 4 in FIG. 20) installed to the center of the combustor body 1 (FIG. 20) and has a plurality of main nozzles 3 whose downstream-side tips are covered by main burners 5 installed to the circumference of the pilot nozzle 2. Then, by having pilot swirls 6 provided to the downstream-side outer wall surface of the pilot nozzle 2, the pilot nozzle 2 is supported so as to be placed in the center of the pilot cone 4*a*. Additionally, by having main swirls 7 installed to the downstream-side outer wall surfaces of the main nozzles 3, the main nozzles 3 are supported so as to be placed in the center of the main burners 5.

Being constructed as described hereinabove, the pilot cone 4*a* has a tapered form so as to spread out toward the downstream-side tip in a radial pattern. (The portion spreading out in the radial pattern is referred as the "tapered portion of the inner circumference of a cone" hereinafter.) Then, the outer circumference of the downstream-side tip of the tapered portion of the inner circumference of a cone 41 has a collar 42 installed thereto, serving as an approximately vertical surface against the axial direction of the pilot nozzle 2. The collar 42 is formed in a ring spreading from the downstream-side tip of the tapered portion of the inner circumference of a cone 41 toward the downstream-side tips of the main burners 5. Additionally, the collar 42 is installed so as to be located on the downstream side for about several millimeters from the downstream-side tips of the main burners 5.

In addition, the pilot cone 4*a* has a tapered cylinder 43 spreading toward the downstream side in a radial pattern installed to the outer circumference of the tapered portion of the inner circumference of a cone 41. Same as the tapered portion of the inner circumference of a cone 41, the cylinder 43 has the downstream-side tip thereof provided with a ring collar 44 serving as an approximately vertical surface against the axial direction of the pilot nozzle 2 so as to confront the collar 42. Additionally, the collar 44 is installed to the position of the downstream-side tips of the main burners 5. Then, the cylinder 43 is installed so as to have a space formed between the cylinder 43 and the tapered portion of the inner circumference of a cone 41. Wherein, a space is also made between the collar 42 of the tapered portion of the inner circumference of a cone 41 and the collar 44 of the cylinder 43.

By forming the pilot cone 41 so as to spread in a radial pattern as described hereinabove, the pilot fuel being injected from the fuel injection ports 21 which are provided to the outer circumference of the tip of the pilot nozzle 2 is diffused and burned by the pilot air passing through the pilot swirls 6 and introduced to the downstream-side tips of the main burners 5. Then, the pilot diffusion flame is led to the flame-stabilizing low-speed zone "X" being formed on the downstream side of the collar 42 of the tapered portion of the inner circumference of a cone 41, along the inner wall of the tapered portion of the inner circumference of a cone 41. The flame-stabilizing low-speed zone "X" is sized in accordance with the width "1" of the collar 42 of the tapered portion of the inner circumference of a cone 41.

Moreover, in flowing into the space between the tapered portion of the inner circumference of a cone 41 and the cylinder 43, the air passing through the outer circumference of the pilot cone 4*a* flows out to the downstream-side tips of the main burners 5, passing through the space between the collar 42 and the collar 44, and flows into the portion serving as the boundary between the main burners 5 and the pilot cone 4*a*, being in a form of film. By flowing the air in film to the boundary in the above-mentioned manner, flashback being caused by the flame in the flame-stabilizing low-speed zone "X" can be prevented. Additionally, because the air passes through the space between the tapered portion of the inner circumference of a cone 41 and the cylinder 43, the tapered portion of the inner circumference of a cone 41 and the collar 42 can be cooled.

By having the flame-stabilizing low-speed zone "X" formed by the collar 42 of the tapered portion of the inner circumference of a cone 41, where the angle being formed by the line connecting the periphery of the downstream-side tip of the pilot nozzle 2 to the periphery of the downstream-side tips of the main burners 5 at the nearest point thereof and the axial direction of the pilot nozzle 2 is "$\alpha x$," the opening angle "$\theta$" of the tapered portion of the inner circumference of the main cone 41 is specified to be "$0° < \theta < 2\alpha$ x." Wherein, it is preferable that the opening angle "$\theta$" is 60° or less, and more preferable, narrower than the angle of "37°±3°."

In consequence, because the width "1" of the collar 42 being formed inside the area connecting the main burners 5 respectively can be sufficiently wide and the area thereof can be made sufficiently large, the size of the flame-stabilizing low-speed zone "X" being formed on the downstream side of the collar 42 can be made sufficiently large, thereby enhancing the flame stability. Additionally, because the collar 42 does not protrude from the downstream-side tips of the main burners 5, no stagnant areas are formed at the downstream-side tips of the main burners 5, thereby preventing flashback from occurring.

TENTH EMBODIMENT

Figure 12:
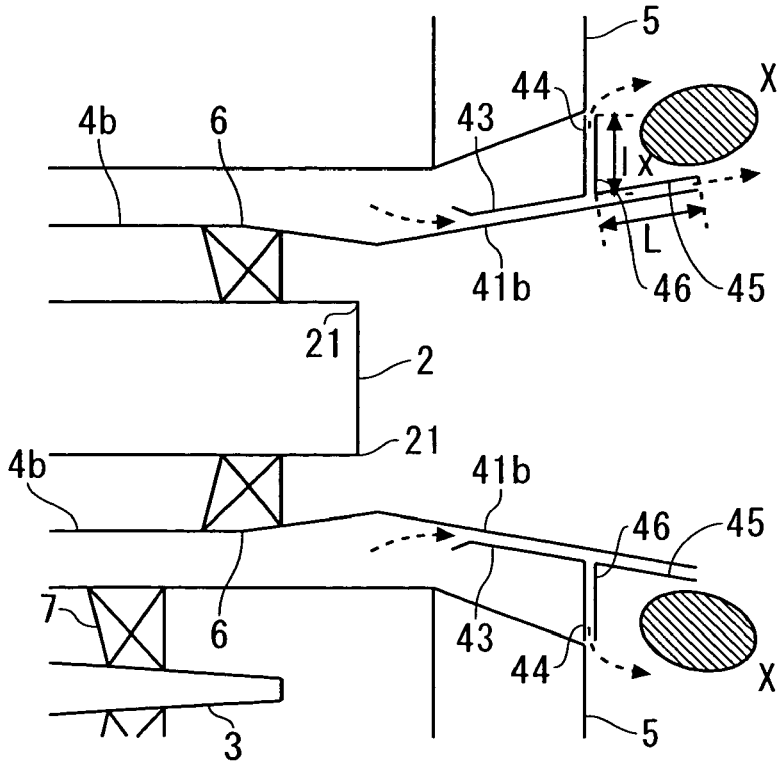
FIG. 12 is a figure showing a construction of vicinity of a tip of a pilot nozzle of a combustor in accordance with a tenth embodiment of the present invention.

A tenth embodiment of the present invention will be described by referring to a figure. FIG. 12 shows the construction of vicinity of a tip of a pilot nozzle of the combustor in accordance with the tenth embodiment of the present invention. In FIG. 12, same symbols will be used for the same portions in FIG. 11, and detailed explanation thereof will be omitted.

Being different from the combustor in accordance with the ninth embodiment (FIG. 11), the combustor in FIG. 12 is provided with a pilot cone 4*b* (being equivalent to the pilot cone 4 in FIG. 20) whose downstream-side tip is formed so as to extend to more downstream than the downstream-side tips of the main burners 5. The pilot cone 4*b* is formed so as to have the tapered portion of the inner circumference of a cone 41*b* extend from the downstream-side tips of he main burners 5, wherein the outer circumference of the tapered portion of the inner circumference of a cone 41*b* has the cylinder 43 engaged thereto from the downstream-side tips of the main burners 5 toward the upstream and has the cylinder 45 engaged thereto from the downstream-side tips of the main burners 5 toward the downstream.

Same as the ninth embodiment, the cylinder 43 has a collar 44 installed to the downstream-side tip thereof, and the cylinder 45 has a collar 46 installed to the upstream-side tip thereof so as to confront the collar 44. Same as the ninth embodiment, the collar 44 is formed in a ring so as to spread from the downstream-side tip of the cylinder 43 toward the downstream-side tips of the main burners 5, and the collar 46 is formed in a ring so as to spread from the upstream-side tip of the cylinder 45 toward the downstream-side tips of the main burners 5. The cylinder 45 being provided with the collar 46 is installed in a manner that the downstream-side tip thereof corresponds to the downstream-side tip of the tapered portion f the inner circumference of a cone 41*b*.

Additionally, the cylinders 43 and 45 are installed so as to have spaces provided between the tapered portion of the inner circumference of a cone 41*b* and the cylinder 43, between the tapered portion of the inner circumference of a cone 41*b* and the cylinder 45, and between the collar 44 and the collar 46. As a result, because the collar 44 of the cylinder 43 is installed at the position of the downstream-side tips of the main burners 5, the collar 46 of the cylinder 45 is installed at the position drifting for several millimeters toward the downstream side from the downstream-side tips of the main burners 5.

Moreover, in the cylinder 45, it is preferable that the length "L" along the tapered portion of the inner circumference of a cone 41*b* is one through three times as much as the width "lx" of the collar 44 or the collar 46. Constructed as mentioned hereinabove, the pilot air flowing along the inner wall of the pilot cone 4*b* after passing through the pilot swirls 6 flows into the flame-stabilizing low-speed zone "X" being formed on the outer circumference of the cylinder 45, which can decrease the temperature of the flame-stabilizing low-speed zone as well as prevent the fuel density from being diluted.

In addition, by flowing the air from the space between the collar 44 and the collar 46, being in the form of film, flashback to the downstream-side tips of the main burners 5 can be prevented; and by flowing the air from the space between the tapered portion of the inner circumference of a cone 41*b* and the cylinder 45, being in the form of film, it is further ensured that the pilot air can be prevented from flowing into the flame-stabilizing low-speed zone "X." Moreover, it is preferable that the opening angle "$\theta$" of the tapered portion of the inner circumference of a cone 41*b* is specified to be "$0° \leqq \theta < 2\alpha x$" in the same manner as the first embodiment, so as to be 60° or less. It is more preferable that the opening angle "$\theta$" is narrower than the angle of "37±3°."

ELEVENTH EMBODIMENT

Figure 13:
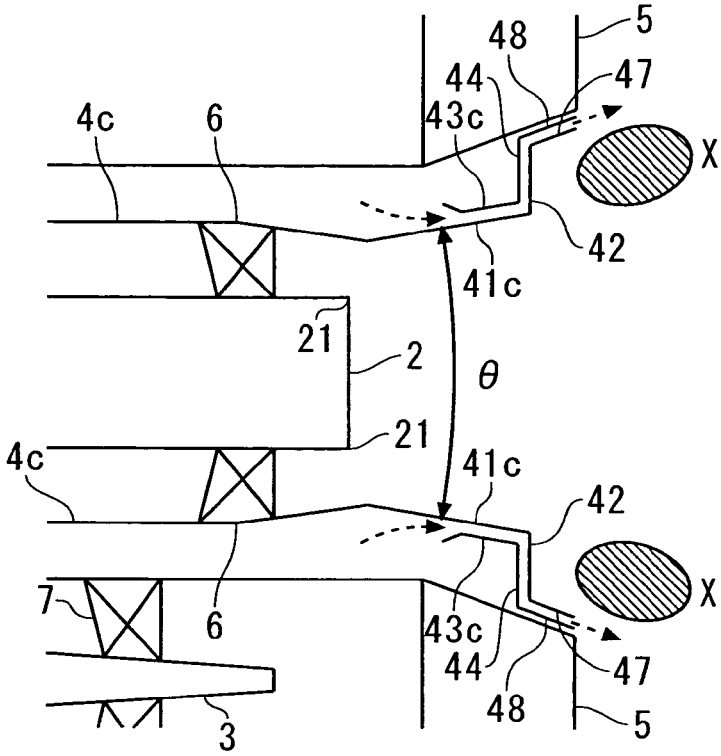
FIG. 13 is a figure showing a construction of vicinity of a tip of a pilot nozzle of a combustor in accordance with an eleventh embodiment of the present invention.

An eleventh embodiment of the present invention will be described by referring to figures. FIG. 13 shows the construction of vicinity of a tip of a pilot nozzle of the combustor in accordance with the eleventh embodiment of the present invention. In FIG. 13, same symbols will be used for the same portions in FIG. 11, and detailed explanation thereof will be omitted.

Being different from the combustor in accordance with the ninth embodiment (FIG. 11), the combustor in FIG. 13 is provided with a pilot cone 4*c* (being equivalent to the pilot cone 4 in FIG. 20) having a tapered portion of the inner circumference of a cone 41*c* which is installed to the upstream side of the downstream-side tips of the main burners 5. The pilot cone 4*c* has the downstream-side tip of the tapered portion of the inner circumference of a cone 41*c* provided to the upstream side of the downstream-side tips of the main burners 5.

Then, the downstream-side tip of the tapered portion of the inner circumference of a cone 41*c* has a collar 42 installed thereto, serving as a vertical surface against the axial direction of the pilot nozzle 2; and at the same time, the outer edge of the collar 42 has a cylinder 47 installed thereto, being tapered so as to be adjacent to the main burners 5. To put it plainly, the diameter of the section which joins to the collar 42 of the tapered portion of the inner circumference of a cone 41*c* coincides with the diameter of the inner edge of the collar 42, and the diameter of the upstream-side tip of the cylinder 47 coincides with the diameter of the outer edge of the collar 44.

Additionally, same as the ninth embodiment, the pilot cone 4*c* has a cylinder 43*c*, which has a collar 44 provided to the position confronting to the collar 42, installed to the outer circumference of the tapered portion of the inner circumference of a cone 41*c*. Then, the cylinder 43*c* also has a cylinder 48 installed thereto, being tapered so as to be along the cylinder 47 on the outer edge of the collar 44. To put it plainly, the diameter of the section which joins to the collar 44 of the cylinder 43*c* coincides with the diameter of the inner edge of the collar 44, and the diameter of the upstream-side tip of the cylinder 48 coincides with the diameter of the outer edge of the collar 44. By installing a cylinder 43*c* between the main burners 5 and the tapered portion of the inner circumference of a cone 41*c* as mentioned hereinabove, it is possible to have the air passing through the outer circumference of the pilot cone 4*c* flow through the gap between the tapered portion of the inner circumference of a cone 41*c* and the cylinder 43*c*.

Moreover, same as the ninth embodiment, the opening angle "θ" on the upstream side of the collar 42 of the tapered portion of the inner circumference of a cone 41*c* is specified to be "$0° \leqq \theta < 2\alpha x$." It is preferable that the opening angle "θ" is 60° or less, and more preferable, narrower than the angle of "37±3°." As just described, the collar 42 can obtain sufficient width and sufficient large area thereof in the same manner as the ninth embodiment. Constructed as hereinabove, a flame-stabilizing low-speed zone "X" having a sufficient size is formed on the downstream side of the collar 42.

In addition, the air passing through the outer circumference of the pilot cone 4*c* flows into the space between the tapered portion of the inner circumference of a cone 41*c* and the cylinder 43*c*, and flows from the space between the cylinder 47 and the cylinder 48 to the boundary between the main burners 5 and the pilot cone 4*a*, being in the form of film. At this time, because the cylinders 47 and 48 are shaped so as to be along the tips of the main burners 5, it can be ensured that the air flows in parallel with the air-fuel pre-mixture flowing from the main burners 5 and that an air space in the form of film is formed. In consequence, the flame stability in the flame-stabilizing low-speed zone "X" can be maintained and resistance to the flashback can be enhanced.

Figure 14:
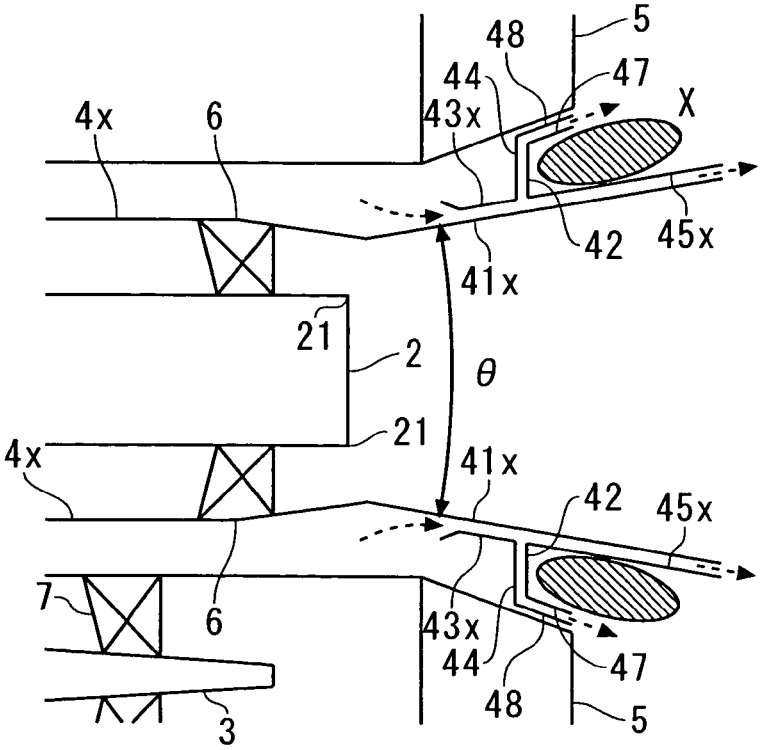
FIG. 14 is a figure showing another construction of vicinity of a tip of a pilot nozzle of a combustor in accordance with an eleventh embodiment of the present invention.

Additionally, in the eleventh embodiment, as shown in FIG. 14, the shape of the pilot cone 4*x* may be formed in the same manner as the tenth embodiment so as to have the tapered portion of the inner circumference of a cone 41*x* and cylinders 43*x* and 45*x* provided thereto. To put it plainly, the cylinder 43*x* is installed so as to be engaged to the upstream side of the tapered portion of the inner circumference of a cone 41*x* and at the same time, the cylinder 45*x* is installed so as to be engaged to the downstream side of the tapered portion of the inner circumference of a cone 41*x*. Moreover, the collars 44 and 46 being installed to the cylinders 43*x* and 45*x*, respectively are provided to the upstream side of the downstream-side tips of the main burners 5. Furthermore, the outer edge of the collar 44 is provided with a cylinder 48 extending to the downstream-side tips of the main burners 5, while the collar 46 is provided with a cylinder 49 being shaped so as to be along the inner circumference of the cylinder 48.

TWELFTH EMBODIMENT

Figure 15:
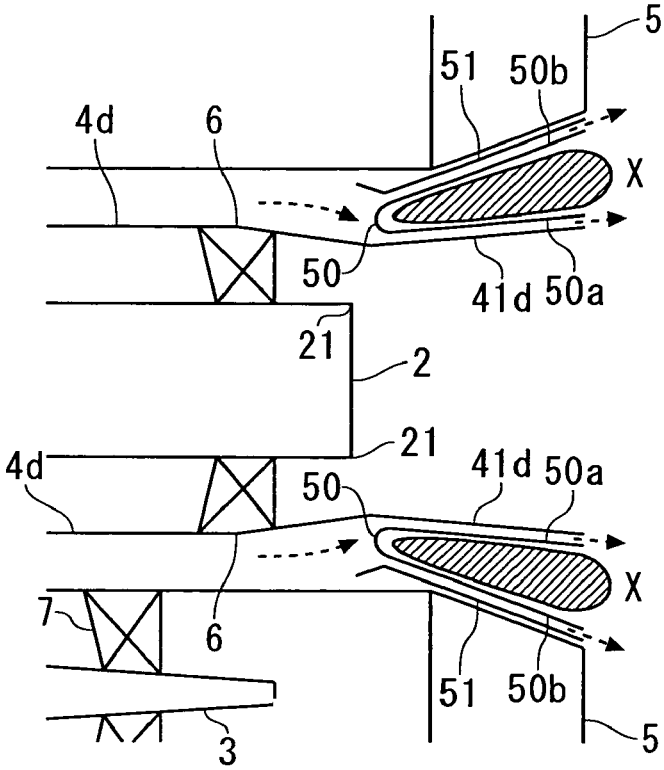
FIG. 15 a figure showing a construction of vicinity of a tip of a pilot nozzle of a combustor in accordance with a twelfth embodiment of the present invention.

A twelfth embodiment of the present invention will be described by referring to a figure. FIG. 15 shows the construction of vicinity of a tip of a pilot nozzle of the combustor in accordance with the twelfth embodiment of the present invention. In FIG. 15, same symbols will be used for the same portions in FIG. 11, and detailed explanation thereof will be omitted.

Being different from the combustor in accordance with the ninth embodiment (FIG. 11), the combustor in FIG. 15 is provided with a pilot cone 4*d* (being equivalent to the pilot cone 4 in FIG. 20) having a double cylinder which consists of a cylinder 50*a* and 50*b* having each of the downstream-side tips thereof connected with the outer circumference of the tapered portion of the inner circumference of a cone 41*d*. In the double cylinder 50, the cylinder 50*a* is formed so as to be along the tapered portion of the inner circumference of a cone 41*d* and at the same time, the cylinder 50*b* being provided to the outer circumference of the cylinder 50*a* is formed so as to be along the main burners 5. Additionally, the pilot cone 4*d* has a cylinder 51 provided thereto between the cylinder 50*b* of the double cylinder 50 and the main burners 5.

Being constructed as described hereinabove, a stagnant area is completely formed in a hollow which is formed toward the upstream-side tip of the double cylinder 50, so that the low-speed flame-stabilizing zone "X" gets into the recess of the hollow of the double cylinder 50. Consequently, it is possible to make the low-speed flame-stabilizing zone "X" being formed in the vicinity of the opening of the double cylinder 50 larger by forming it into the recess of the hollow of the double cylinder 50, thereby enhancing the flame stability thereof.

In addition, a part of the air flowing through the outer circumference of the pilot cone 4*d* flows out from the downstream-side tip of the tapered portion of the inner circumference of a cone 41*d*, being in a form of film, after flowing into the space between the tapered portion of the inner circumference of a cone 41*d* and the cylinder 50*a*. Moreover, a part of the air flowing through the outer circumference of the pilot cone 4*d* flows out from the downstream-side tips of the main burners 5, being in a form of film, after flowing into the space between the cylinder 50*b* and the cylinder 51. As a result, resistance to a flashback to the main burners 5 is enhanced.

THIRTEENTH EMBODIMENT

Figure 16:
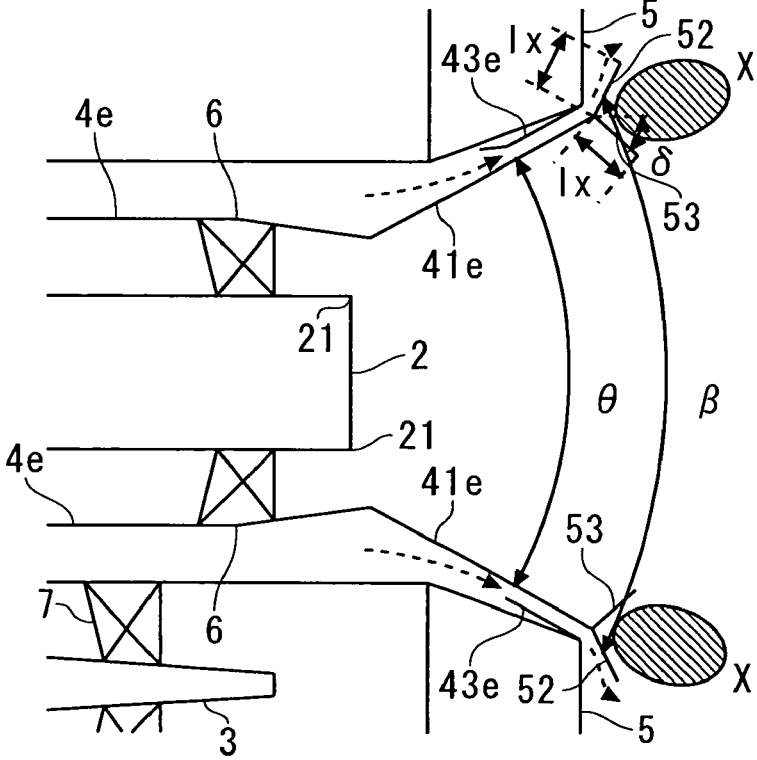
FIG. 16 a figure showing a construction of vicinity of a tip of a pilot nozzle of a combustor in accordance with a thirteenth embodiment of the present invention.

A thirteenth embodiment of the present invention will be described by referring to a figure. FIG. 16 shows the construction of vicinity of a tip of a pilot nozzle of the combustor in accordance with the thirteenth embodiment of the present invention. In FIG. 16, same symbols will be used for the same portions in FIG. 11, and detailed explanation thereof will be omitted.

Being different from the combustor in accordance with the ninth embodiment (FIG. 11), the combustor in FIG. 16 has a pilot cone 4*e* (being equivalent to the pilot cone 4 in FIG. 20) provided with a collar 52 protruding from the downstream-side tip of the tapered portion of the inner circumference of a cone 41*e* to the downstream-side tips of the main burners 5;

and a cylinder 53 having the upstream-side tip thereof connected to the downstream-side tip of a tapered portion of the inner circumference of a cone 41*e*. In addition, the pilot cone 4*e* has a cylinder 43*e* installed to the outer circumference of the tapered portion of the inner circumference of a cone 41*e* in a manner that the downstream-side tip thereof comes in contact with the downstream-side tips of the main burners 5.

Then, the downstream-side tip of the pilot cone 4*e* is installed so as to be located on the downstream side of the downstream-side tips of the main burners 5 for several millimeters. Additionally, the opening angle "β" of the collar 52 is set so as to be wider than the opening angle "θ" of the tapered portion of the inner circumference of a cone 41*e*, and, the inner wall of the cylinder 53 faces inward against the axial direction. Here, it is preferable that the angle "67 " being formed by the inner wall of the cylinder 53 and the axial direction of the pilot nozzle 2 is within the range of "$0° \leqq \delta \leqq 60°$." Moreover, the length of the inner wall of the cylinder 53 is set to be approximately the same as the width "lx" of the collar 52.

By being constructed as described hereinabove, a low-speed flame-stabilizing zone "X" is formed in the neighborhood of an area being constructed by the collar 52 and the cylinder 53. Because at this time, the collar 52 and the cylinder 53 are connected with each other at the upstream-side tips thereof respectively, providing a hollow to the upstream side and being shaped so as to open to the downstream side, a stagnant area can be formed in a hollow to the joint portion of the collar 52 and the cylinder 53. Consequently, the low-speed flame-stabilizing zone "X" can be made larger and flame stability thereof can be enhanced.

Additionally, a part of the air flowing through the outer circumference of the pilot cone 4*e* flows out to the downstream-side tips of the main burners 5, being in a form of film, after flowing into the space between the tapered portion of the inner circumference of a cone 41*e* and the cylinder 43*e*. Because the downstream-side tip of the cylinder 43*e* is installed so as to come in contact with the downstream-side tips of the main burners 5, the air can surely be led to the downstream-side tips of the main burners 5, thereby preventing flashback to the to the main burners 5.

FOURTEENTH EMBODIMENT

Figure 17:
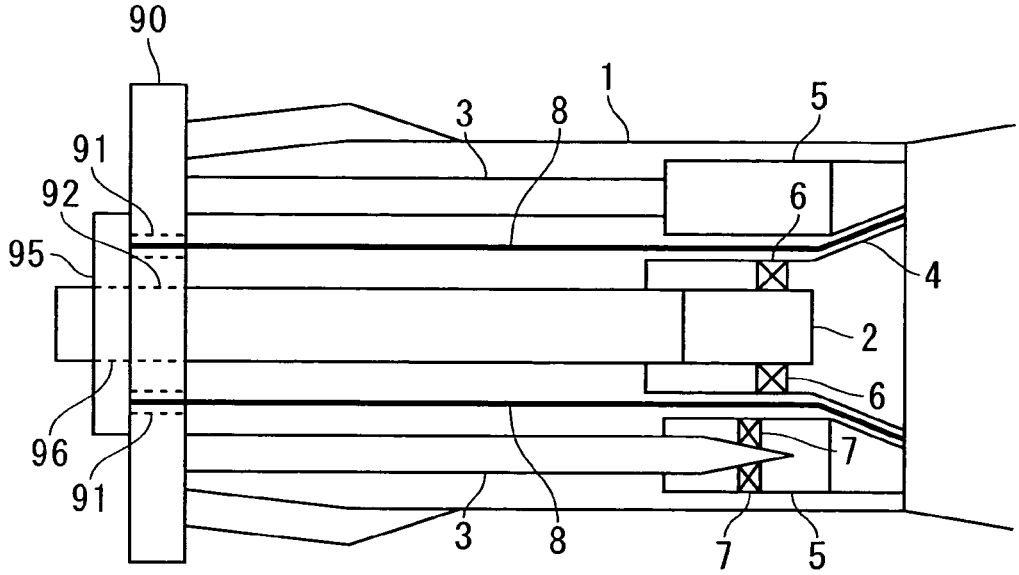
FIG. 17 is schematic block diagram showing a construction of a combustor in accordance with a fourteenth embodiment of the present invention.
Figure 18:
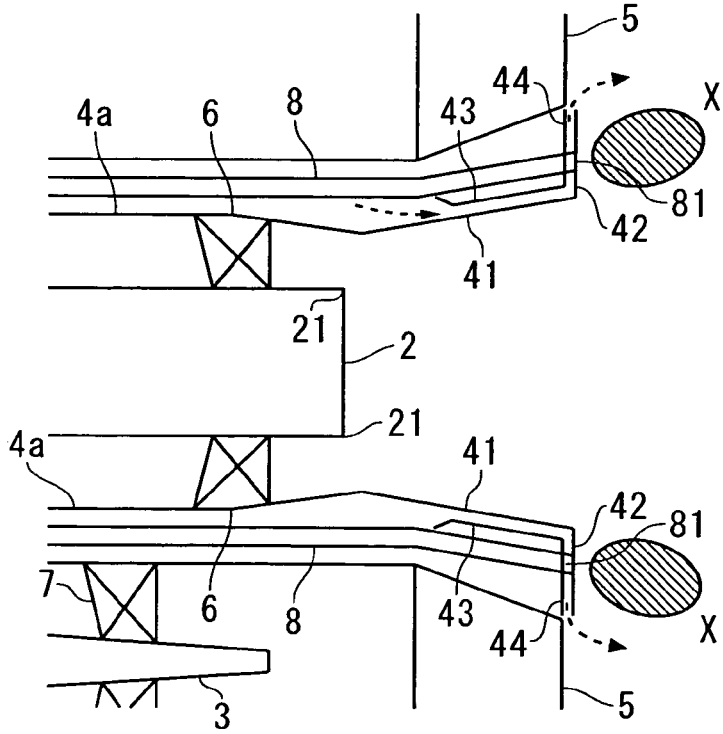
FIG. 18 is a figure showing a construction of a tip of a pilot nozzle of a combustor in accordance with a fourteenth embodiment of the present invention.

A fourteenth embodiment of the present invention will be described by referring to figures. FIG. 17 is a schematic block diagram showing a combustor in accordance with the fourteenth embodiment. Additionally, FIG. 18 shows the construction of the vicinity of a tip of a pilot nozzle of the combustor in accordance with the fourteenth embodiment of the present invention. In FIG. 17 and FIG. 18, same symbols will be used for the same portions in FIG. 20 and FIG. 11.

A combustor of FIG. 17 has a combustor main body 1, a pilot nozzle 2, main nozzles 3, a pilot cone 4, main burners 5, pilot swirls 6, main swirls 7, a plurality of flame-stability-enhancing fuel supply channels 8 being installed between the pilot nozzle 2 and the main nozzles 3, a main fuel manifold 90 being connected to the main nozzles 3 and supplying a fuel to the main nozzles 3, and a flame-stability-enhancing fuel manifold 95 being connected to the flame-stability-enhancing fuel supply channels 8 and supplying a fuel to the flame-stability-enhancing fuel supply channels 8.

A same number of flame-stability-enhancing fuel supply channels 8 as that of the main nozzles 3 are installed in such a manner as the centers thereof are located on a line connecting the center of the pilot nozzle 2 to the centers of the main nozzles 3. (However, the same number of flame-stability-enhancing fuel supply channels 8 should not necessarily be installed as that of the main nozzles, but appropriate number may be installed.) Additionally, the flame-stability-enhancing fuel manifold 95 is installed upstream of the main fuel manifold 90, and the flame-stability-enhancing fuel supply channels 8 being connected to the flame-stability-enhancing fuel manifold 95 are inserted into a hole 91 being provided in the main fuel manifold 90. Moreover, the pilot nozzle 2 is inserted into holes 92 and 96 being made in the centers of the main fuel manifold 90 and flame-stability-enhancing fuel manifold 95, respectively.

Figure 19:
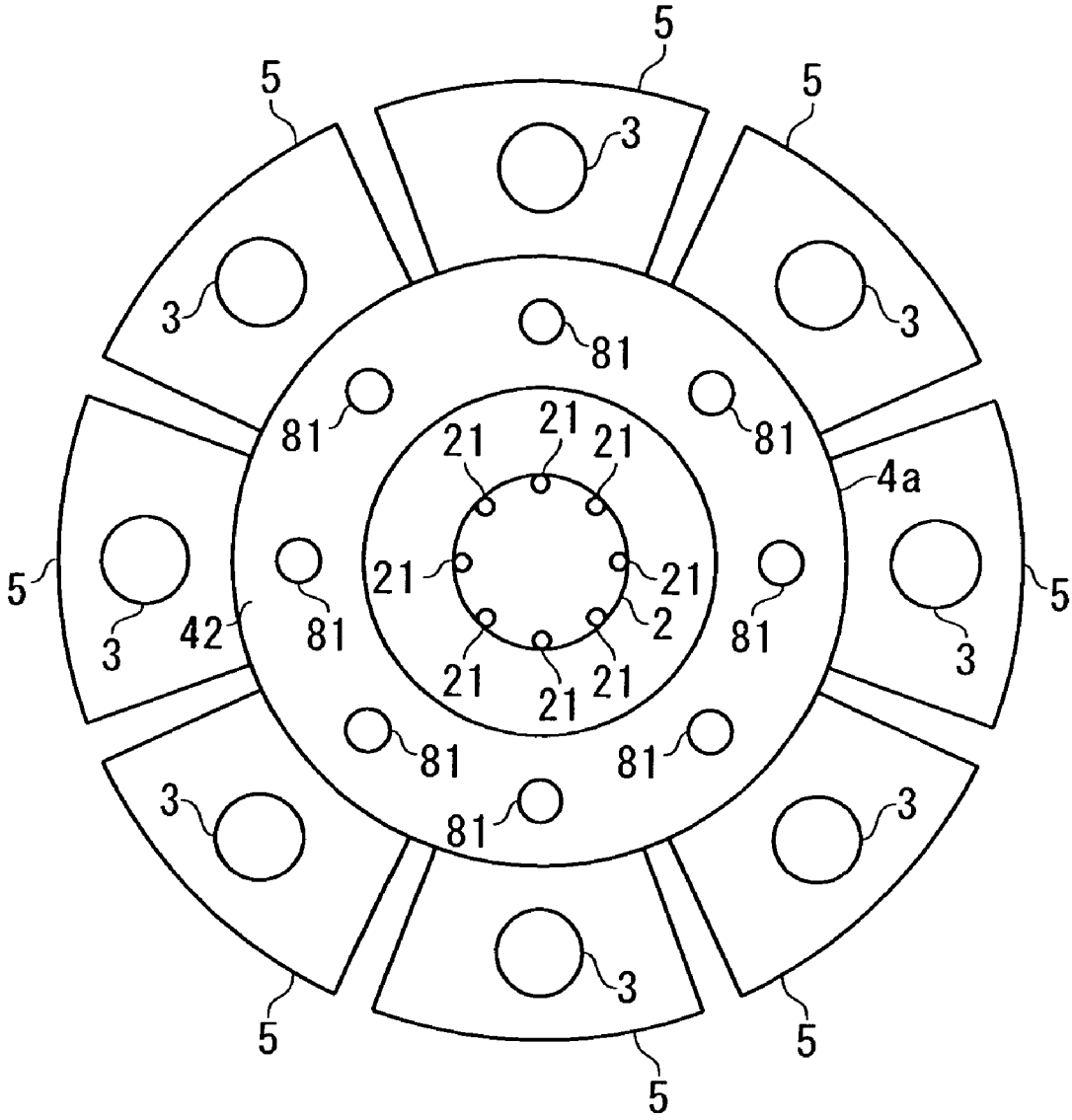
FIG. 19 is a schematic block diagram of a combustor viewed from the downstream side thereof in accordance with a fourteenth embodiment of the present invention.

In a combustor being constructed as described hereinabove, as shown in FIG. 18, a pilot cone 4*a* having a same shape as the ninth embodiment (FIG. 11) is used. Here, in order to supply a fuel from flame-stability-enhancing fuel supply channels 8 to a low-speed flame-stabilizing zone "X" being formed in the neighborhood of the collar 42, flame-stability-enhancing fuel supply channels 8 are provided so as to penetrate through the collars 42 and 44, and the collar 42 is provided with a flame-stability-enhancing fuel injection port 81. Moreover, because the flame-stability-enhancing fuel supply channels 8 are installed so as to be on the line connecting the center of the pilot nozzle and the centers of the main nozzles, when there are eight main nozzles 3, for example, as shown in FIG. 19, eight flame-stability-enhancing fuel injection ports 81 are provided to the collar 42 of the pilot cone 4*a*, corresponding respectively.

By constructing as described hereinabove, a fuel being supplied from the flame-stability-enhancing fuel manifold 95 is injected to the low-speed flame-stabilizing zone "X" from the flame-stability-enhancing fuel injection ports 81 after passing through the flame-stability-enhancing fuel supply channels 8. By this, the fuel being injected from the flame-stability-enhancing fuel injection ports 81 burns in the low-speed flame-stabilizing zone "X," thereby enhancing the flame stability in the low-speed flame-stabilizing zone "X."

In addition, in the fourteenth embodiment, an example is given wherein flame-stabilizing-enhancing fuel supply channels 8 are installed to a combustor being provided with a pilot cone 4*a* in accordance with the ninth embodiment of the present invention, but may be installed to the combustor being provided with the pilot cones 4*b* through 4*e* in accordance with the tenth through the thirteenth embodiments. At this time, the pilot cone 4*b* has the flame-stability-enhancing fuel supply channels 8 provided so as to penetrate through the collars 44 and 46; the pilot cone 4*c* has the flame-stability-enhancing fuel supply channels 8 provided so as to penetrate through the collars 42 and 44; the pilot cone 4*d* has the flame-stability-enhancing fuel supply channels 8 so as to penetrate through the joint portion of the cylinders 50*a* and 50*b*; and the pilot cone 4*e* has the flame-stability-enhancing fuel supply channels 8 so as to penetrate through the joint portion of the collar 52 and the cylinder 53. By this, the fuel passing through the flame-stability-enhancing fuel supply channels 8 being provided respectively is injected to the low-speed flame-stabilizing zone "X."

Moreover, the combustors in accordance with the ninth through the fourteenth embodiments may have the vicinity of the pilot nozzle thereof constructed in such a manner as the first through the eight embodiments. Here, the construction of the vicinity of the pilot nozzle thereof may be constructed so as to have a combination of characteristics that are described in the first through the eight embodiments.

As described above, in accordance with the present invention, it is possible to induce a large amount of fuel to a low-speed flame-stabilizing zone which is formed in the vicinity of the downstream-side tip of a pilot cone, by making the fuel being injected from the fuel injection ports bump against the proximity of the downstream-side tip of the pilot cone, which enhances the flame stability of pilot diffusion flames. Additionally, by injecting the fuel being injected from the fuel injection ports in parallel with the inner wall surface of the pilot cone, a large volume of fuel can be induced to the low-speed flame-stabilizing zone which is formed in the vicinity of the downstream-side tip of the pilot cone, thereby enhancing the flame stability of the pilot diffusion flames. Because by enhancing the flame stability of the pilot diffusion flames in the low-speed flame-stabilizing zone in a manner as mentioned hereinabove, combustion vibrations can be reduced, which can decrease the pilot ratio of the fuel being supplied to a combustor, thereby realizing the reduction of NOx.

Additionally, in accordance with the present invention, by injecting a fuel from the fuel injection ports to an area consisting of a pilot nozzle cover and a pilot nozzle and generating an air-fuel pre-mixture in which the fuel and the air are mixed so as to be supplied to the neighborhood of the pilot diffusion flames caused by the fuel being injected from the first fuel injection pipe, the flame stability of the pilot diffusion flames can be enhanced. Furthermore, because an air-fuel pre-mixture can be supplied so as to surround the pilot diffusion flames by having the pilot nozzle cover consist of the first cylinder cover and the second cylinder cover and generating air-fuel pre-mixture in the area between the pilot nozzle and the second cylinder cover and in the area between the first cylinder cover and the second cylinder cover, respectively, the flame stability of the pilot diffusion flames can be enhanced further. Moreover, by installing the second fuel injection pipe and generating the air-fuel pre-mixture only in the area between the first cylinder cover and the second cylinder cover, the downstream-side tip of the pilot nozzle can surely be cooled with the air passing through the area between the second cylinder cover and the pilot nozzle.

In addition, in accordance with the present invention, by providing a collar to the downstream-side tip of the cylinder being in contact with the downstream-side surface of the pilot swirl, the air passing through the outer circumference of the pilot nozzle is prevented from flowing to the downstream-side tip of the pilot nozzle, thereby enabling the air to flow into the base of the jet flow of the fuel being injected from the fuel injection ports. In consequence, combustion can be achieved without weakening the pilot diffusion flames.

Furthermore, by not installing the fuel injection ports to the position being close to the area having a hollow such as a bypass pipe, a connection pipe and the like at the downstream-side tip of the pilot nozzle, a stagnant area of a fuel can be prevented from being formed in the areas having a hollow such as a bypass pipe, a connection pipe and the like. Additionally, by slightly opening a bypass valve in the state of combustion, a stagnant area of a fuel can be prevented from being formed by a hollow of a bypass pipe. In consequence, instability of combustion in the stagnant area can be reduced.

In accordance with the present invention, because a collar portion is provided to the downstream-side tip of the pilot cone, a low-speed flame-stabilizing zone can be made large and surely be formed on the downstream side of the collar portion. In consequence, the flame stability of an air-fuel pre-mixture in which the fuel from the main burners and the air are mixed can be enhanced, thereby reducing the combustion vibrations. Additionally, because by providing a cylinder to the outer circumference of the tapered portion of the inner circumference of a cone, the air can be flowed in a form of a film from the downstream-side tips of the main burners, the collar portion for flame stabilizing can be cooled and the flashback to the main burners can be prevented.

Also, because by having the tapered portion of the inner circumference of a cone provided with a cylinder portion extending from the joint portion with the collar portion, the pilot air flows along the tapered portion of the inner circumference of a cone so as to be prevented from flowing into the low-speed flame-stabilizing zone, the flame stability in the low-speed flame-stabilizing zone can be enhanced. Moreover, because by providing a double cylinder to the outer circumference of the tapered portion of the inner circumference of a cone, a stagnant area can be formed in the hollow of the double cylinder, the flame stability can be enhanced by forming a low-speed flame-stabilizing zone into the recess of the hollow and making the size thereof large. Furthermore, the low-speed flame-stabilizing zone can surely be formed by the first and the second cylinders protruding to the main nozzles and the pilot nozzle, respectively, as well as the pilot air flowing along the tapered portion of the inner circumference of a cone can be prevented from flowing into the low-speed flame-stabilizing zone by the second cylinder.

Additionally, by providing a plurality of flame-stability-enhancing fuel supply channels so as to have the fuel pass between the pilot cone and the main burners, supply to the low-speed flame-stabilizing zone is possible through the flame-stability-enhancing fuel supply channels. In consequence, the flame stability in the low-speed flame-stabilizing zone can be enhanced.

What is claimed is:

1. A combustor comprising:

a pilot nozzle located at a center portion of a main body of the combustor;

a plurality of main nozzles located at a surrounding area of the pilot nozzle, each respective main nozzle of the plurality of main nozzles being spaced apart at a regular interval;

a pilot cone covering a downstream-side tip portion of the pilot nozzle; and main burners covering downstream-side tip portions of the plurality of main nozzles, wherein, the pilot cone comprises:

a cone having a tapered portion located at an inner circumference thereof, such that the tapered portion of the cone forms a tapered shape stretching outwardly in a radial pattern toward a downstream side of the combustor;

a cylinder installed therein, such that a space is formed between the cylinder and an outer wall of the tapered portion of the inner circumference of the cone; and a collar portion located at an external periphery of a downstream-side tip of the tapered portion of the inner circumference the cone, such that the collar portion is located on a downstream side of downstream-side tips of the main burners and such that the collar portion provides a surface extending approximately vertical to an axial direction of the pilot nozzle, wherein, an angle measured from a line extending in the axial direction to a line that connects an external periphery of a downstream-side tip of the pilot nozzle with an external periphery of the downstream-side tips of the main burners is specified as "$\alpha x$," and wherein an opening angle, measured at the tapered portion of the inner circumference of the cone is specified as "$\theta$" wherein "$0<\theta<2\alpha x$.".

2. A combustor as described in claim 1, wherein the pilot cone further comprises:

a ring collar installed at a position in the axial direction of the downstream-side tips of the main burners, such that a space is formed between the ring collar and the collar, and such that the ring collar provides a surface extending approximately vertical to the axial direction of the pilot nozzle so as to confront the collar.

* * * * *